US011859267B2

(12) United States Patent
Reed et al.

(10) Patent No.: US 11,859,267 B2
(45) Date of Patent: Jan. 2, 2024

(54) NICKEL-BASED ALLOY

(71) Applicant: OXFORD UNIVERSITY INNOVATION LIMITED, Oxford (GB)

(72) Inventors: Roger Reed, Oxford (GB); David Crudden, Oxford (GB)

(73) Assignee: OXFORD UNIVERSITY INNOVATION LIMITED, Oxford (GB)

( * ) Notice: Subject to any disclaimer, the term of this patent is extended or adjusted under 35 U.S.C. 154(b) by 0 days.

(21) Appl. No.: 16/340,784

(22) PCT Filed: Sep. 13, 2017

(86) PCT No.: PCT/GB2017/052691
§ 371 (c)(1),
(2) Date: Apr. 10, 2019

(87) PCT Pub. No.: WO2018/069666
PCT Pub. Date: Apr. 19, 2018

(65) Prior Publication Data

US 2020/0048742 A1 Feb. 13, 2020

(30) Foreign Application Priority Data

Oct. 12, 2016 (GB) ..... 1617326

(51) Int. Cl.
*C22C 19/05* (2006.01)

(52) U.S. Cl.
CPC ..... *C22C 19/056* (2013.01)

(58) Field of Classification Search
CPC ..... C22C 19/057; C22C 19/056; C22F 1/10
See application file for complete search history.

(56) References Cited

U.S. PATENT DOCUMENTS

| | | | | |
|---|---|---|---|---|
| 2,570,193 | A | 10/1951 | Bieber et al. | |
| 3,155,501 | A * | 11/1964 | Kaufman | C22C 19/00 420/448 |
| 3,164,465 | A | 1/1965 | Thielemann | |
| 3,166,412 | A | 1/1965 | Bieber et al. | |
| 3,293,030 | A | 12/1966 | Child et al. | |
| 3,677,747 | A | 7/1972 | Lund et al. | |
| 5,476,555 | A * | 12/1995 | Erickson | C22C 19/056 148/410 |
| 5,820,700 | A * | 10/1998 | DeLuca | C22F 1/10 148/404 |
| 6,969,431 | B2 * | 11/2005 | Hieber | C22C 1/0433 148/428 |
| 7,887,748 | B2 | 2/2011 | Volek | |
| 2003/0005981 | A1 * | 1/2003 | Ogawa | C22C 19/056 148/428 |
| 2008/0008618 | A1 * | 1/2008 | Sato | C22C 19/057 420/448 |
| 2013/0142637 | A1 | 6/2013 | Harris et al. | |
| 2015/0354358 | A1 | 12/2015 | Grande et al. | |
| 2017/0058383 | A1 | 3/2017 | Goehler et al. | |

FOREIGN PATENT DOCUMENTS

| | | |
|---|---|---|
| CN | 101121977 | 2/2008 |
| CN | 101538664 | 9/2009 |
| CN | 102107306 | 6/2011 |
| CN | 103352192 | 10/2013 |
| CN | 104096694 | 10/2014 |
| CN | 104096697 | 10/2014 |
| CN | 104096703 | 10/2014 |
| CN | 104096796 | 10/2014 |
| CN | 104096797 | 10/2014 |
| CN | 104096798 | 10/2014 |
| CN | 104096799 | 10/2014 |
| CN | 104096800 | 10/2014 |
| CN | 104096801 | 10/2014 |
| CN | 104096802 | 10/2014 |
| CN | 104096803 | 10/2014 |
| CN | 104096804 | 10/2014 |
| CN | 104096805 | 10/2014 |

(Continued)

OTHER PUBLICATIONS

International Search Report and Written Opinion issued in International Patent Application No. PCT/GB2017/052691, dated Nov. 30, 2017.
Search Report issued in Corresponding UK Patent Application No. GB16173262, dated Mar. 24, 2017 .
Decision on Rejection, dated May 20, 2021, issued in corresponding Chinese Application No. 201780074962.3. (see reference to Chen et al., "Casting alloy and its smelting[M]").
Laisu Chen et al., "Casting alloy and its smelting[M]", *Northwestern Polytechnical University Press*, p. 270, Dec. 1994. (Chinese only).
Office Action issued in Corresponding Japanese Application No. 2019-520129, dated Nov. 2, 2021 (English Translation provided).
Third Party Observations (Article 115EPC) against EP3526355 issued by the European Patent Office in corresponding Application No. 177718392 dated Apr. 30, 2021.

(Continued)

*Primary Examiner* — Jessee R Roe
(74) *Attorney, Agent, or Firm* — NORTON ROSE FULBRIGHT US LLP

(57) ABSTRACT

A nickel-based alloy composition consisting, in weight percent, of: between 4.0% and 6.9% aluminium, between 0.0% and 23.4% cobalt, between 9.1% and 11.9% chromium, between 0.1% and 4.0% molybdenum, between 0.6% and 3.7% niobium, between 0.0 and 1.0% tantalum, between 0.0% and 3.0% titanium, between 0.0% and 10.9% tungsten, between 0.02 wt. % and 0.35 wt. % carbon, between 0.001 and 0.2 wt. % boron, between 0.001 wt. % and 0.5 wt. %. zirconium, between 0.0 and 0.5% silicon, between 0.0 and 0.1% yttrium, between 0.0 and 0.1% lanthanum, between 0.0 and 0.1% cerium, between 0.0 and 0.003% sulphur, between 0.0 and 0.25% manganese, between 0.0 and 0.5% copper, between 0.0 and 0.5% hafnium, between 0.0 and 0.5% vanadium, between 0.0 and 10.0% iron, the balance being nickel and incidental impurities.

18 Claims, 24 Drawing Sheets

(56) References Cited

FOREIGN PATENT DOCUMENTS

| | | |
|---|---|---|
| CN | 104096819 | 10/2014 |
| CN | 104096825 | 10/2014 |
| CN | 104097150 | 10/2014 |
| CN | 104097862 | 10/2014 |
| CN | 104399884 | 3/2015 |
| CN | 104404308 | 3/2015 |
| CN | 104674063 | 6/2015 |
| CN | 104875123 | 9/2015 |
| CN | 204699621 | 10/2015 |
| CN | 204699995 | 10/2015 |
| CN | 204700255 | 10/2015 |
| CN | 204700279 | 10/2015 |
| CN | 204700280 | 10/2015 |
| CN | 204700281 | 10/2015 |
| CN | 204700283 | 10/2015 |
| CN | 204700284 | 10/2015 |
| CN | 105089708 | 11/2015 |
| CN | 105149597 | 12/2015 |
| CN | 106315234 | 1/2017 |
| CN | 106379617 | 2/2017 |
| CN | 106395034 | 2/2017 |
| CN | 206200074 | 5/2017 |
| CN | 206200079 | 5/2017 |
| CN | 206202380 | 5/2017 |
| CN | 206202852 | 5/2017 |
| CN | 206325923 | 7/2017 |
| CN | 107190158 | 9/2017 |
| CN | 206485680 | 9/2017 |
| CN | 107560588 | 1/2018 |
| DE | 102009010026 | 8/2010 |
| DE | 102013021704 | 1/2015 |
| DE | 102013214464 | 1/2015 |
| EP | 1154027 | 11/2001 |
| EP | 1201778 | 5/2002 |
| EP | 1411136 | 4/2004 |
| EP | 1801251 | 6/2007 |
| EP | 1925683 | 5/2008 |
| EP | 1927669 | 6/2008 |
| EP | 1997921 | 12/2008 |
| EP | 2071128 | 6/2009 |
| EP | 2434100 | 2/2012 |
| EP | 2514550 | 10/2012 |
| EP | 2796578 | 10/2014 |
| EP | 2826877 | 1/2015 |
| EP | 2859968 | 4/2015 |
| EP | 2859969 | 4/2015 |
| EP | 2913418 | 9/2015 |
| EP | 2963135 | 1/2016 |
| EP | 3208355 | 8/2017 |
| EP | 3257963 | 12/2017 |
| EP | 3263722 | 1/2018 |
| EP | 3263723 | 1/2018 |
| EP | 3299481 | 3/2018 |
| GB | 968495 | 9/1964 |
| GB | 1013347 | 12/1965 |
| GB | 2554879 | 4/2018 |
| JP | S43-004098 | 2/1968 |
| JP | 2002-294374 | 10/2002 |
| JP | 2005-097650 | 4/2005 |
| JP | 2009-132964 | 6/2009 |
| JP | 2011080146 | 4/2011 |
| JP | 2016-006217 | 1/2016 |
| JP | 2017-179592 | 10/2017 |
| RU | 2070597 | 12/1996 |
| RU | 2148100 | 4/2000 |
| RU | 2410457 | 1/2011 |
| WO | WO 2014/085892 | 6/2014 |
| WO | WO 2016/005724 | 1/2016 |
| WO | WO 2016/033301 | 3/2016 |
| WO | WO 2016/034865 | 3/2016 |
| WO | WO 2017/026519 | 2/2017 |
| WO | WO 2017/077137 | 5/2017 |
| WO | WO 2018/069672 | 4/2018 |

OTHER PUBLICATIONS

Search Report issued in Corresponding Chinese Application No. 2017800749623, dated Jun. 21, 2023 (No English translation provided).

* cited by examiner

NICKEL-BASED ALLOY

CROSS-REFERENCE TO RELATED APPLICATION

This application is a U.S. national phase under 35 U.S.C. § 371 of International Application No. PCT/GB2017/052691, filed Sep. 13, 2017, which claims the benefit of priority to Great Britain Application No. 1617326.2, filed Oct. 12, 2016. The contents of each of the referenced applications are incorporated into the present application by reference.

The present invention relates to a nickel-based superalloy composition for use as a turbine wheel within an exhaust gas turbocharger device. Previously, there has been a tendency to migrate nickel-based superalloys proven on aeroengines to such applications. However, this has proven largely inappropriate probably because the necessary design intent—determined from factors such as exhaust gas temperature and production cost—is then not respected.

Examples of typical compositions of nickel-based superalloys which are used for turbine wheels within a turbocharger devices are listed in Table 1. The alloys IN713C and IN713LC are typically employed in applications where the maximal operation temperature does not exceed 900-950° C.; beyond this temperature the tensile strength and creep resistance of these alloys is insufficient. For temperatures beyond 950° C. it is necessary to use the Mar-M246 and Mar-M247, these alloys can be applied in temperatures up to 1050° C. as they have better high temperature strength and creep resistance. However, the Mar-M246 and Mar-M247 alloys cost significantly more than IN713C and IN713LC, also the corrosion resistance of these alloy is substantially worse. The present invention provides an alloy designed to have an alloy with tensile strength and creep equivalent to the Mar-M246 and Mar-M247 alloy grades. These mechanical properties are achieved in combination with a reduction in alloy cost and an improvement in oxidation/corrosion resistance. The balance of properties for the new alloy make it suitable for many high temperature turbomachinery applications. In particular for use as a turbine wheel within a exhaust gas turbocharger device where increased exhaust gas temperatures require a high degree of mechanical strength as well as resistance to aggressive creep and corrosion damage.

TABLE 1

Nominal composition in wt. % of conventionally cast nickel-based superalloys used for automotive turbochargers.

| Alloy (wt. %) | Al | Co | Cr | Mo | Nb | Ta | Ti | W | C | B | Zr | Hf |
|---|---|---|---|---|---|---|---|---|---|---|---|---|
| IN713C | 6.0 | 0.0 | 13.5 | 4.5 | 2.0 | 0.0 | 0.8 | 0.0 | 0.10 | 0.01 | 0.06 | 0.00 |
| IN713LC | 5.8 | 0.0 | 12.0 | 4.3 | 2.0 | 0.0 | 0.7 | 0.0 | 0.06 | 0.01 | 0.06 | 0.00 |
| Mar-M246 | 5.5 | 10.0 | 9.0 | 2.5 | 0.0 | 1.5 | 1.5 | 10.0 | 0.15 | 0.01 | 0.05 | 0.00 |
| Mar-M247 | 5.5 | 10.0 | 8.2 | 0.6 | 0.0 | 3.0 | 1.0 | 10.0 | 0.16 | 0.015 | 0.05 | 1.50 |

These materials are used to produce the turbine wheel within an exhaust gas turbocharger device because of their outstanding resistance to mechanical and chemical degradation. They contain as many as ten different alloying elements, necessary to confer the desired combination of properties.

It is an aim of the invention to provide a nickel-based alloy used to produce the turbine wheel within an exhaust gas turbocharger device which has mechanical properties equivalent to the strongest alloys used for these applications combined with a reduction in cost and an improvement in oxidation/corrosion resistance.

The present invention provides a nickel-based alloy composition comprising or consisting, in weight percent, of: between 4.0% and 6.9% aluminium, between 0.0% and 23.4% cobalt, between 9.1% and 11.9% chromium, between 0.1% and 4.0% molybdenum, between 0.6% and 3.7% niobium, between 0.0 and 1.0% tantalum, between 0.0% and 3.0% titanium, between 0.0% and 10.9% tungsten, between 0.02 wt. % and 0.35 wt. % carbon, between 0.001 and 0.2 wt. % boron, between 0.001 wt. % and 0.5 wt. %. zirconium, between 0.0 and 0.5% silicon, between 0.0 and 0.1% yttrium, between 0.0 and 0.1% lanthanum, between 0.0 and 0.1% cerium, between 0.0 and 0.003% sulphur, between 0.0 and 0.25% manganese, between 0.0 and 0.5% copper, between 0.0 and 0.5% hafnium, between 0.0 and 0.5% vanadium, the balance being nickel and incidental impurities.

In the present invention, (i) aluminium may be present between 4.0% and less than 4.4% or between 4.4% and 6.9%, and/or (ii) cobalt may be present between 0.0% and less than 0.3% or less than 0.6% or between 0.3% or 0.6% and 23.4% and/or (iii) titanium may be present between 0.0% and 2.0% or between more than 2.0% and 3.0%.

The present invention provides a nickel-based alloy composition comprising or consisting, in weight percent, of: between 4.4% and 6.9% aluminium, between 0.3% or 0.6% and 23.4% cobalt, between 9.1% and 11.9% chromium, between 0.1% and 4.0% molybdenum, between 0.6% and 3.7% niobium, between 0.0 and 1.0% tantalum, between 0.0% and 2.0% titanium, between 0.0% and 10.9% tungsten, between 0.02 wt. % and 0.35 wt. % carbon, between 0.001 and 0.2 wt. % boron, between 0.001 wt. % and 0.5 wt. %. zirconium, between 0.0 and 0.5% silicon, between 0.0 and 0.1% yttrium, between 0.0 and 0.1% lanthanum, between 0.0 and 0.1% cerium, between 0.0 and 0.003% sulphur, between 0.0 and 0.25% manganese, between 0.0 and 0.5% copper, between 0.0 and 0.5% hafnium, between 0.0 and 0.5% vanadium, the balance being nickel and incidental impurities.

In an embodiment, the following equation is satisfied in which $W_{Nb}$, $W_{Ta}$, $W_{Ti}$ and $W_{Al}$ are the weight percent of niobium, tantalum, titanium and aluminium in the alloy respectively $19 \leq (W_{Nb}+W_{Ta}+W_{Ti})+3.2W_{Al} \leq 24.5$, preferably $20 \leq (W_{Nb}+W_{Ta}+W_{Ti})+3.2W_{Al} \leq 24.5$. This achieves a desired volume fraction of γ' and thereby resistance to creep deformation and creep rupture life.

In an embodiment, the following equation is satisfied in which $W_W$ and $W_{Mo}$ are the weight percent of tungsten and molybdenum in the alloy respectively $9.4 \leq W_W+2.9W_{Mo}$, preferably $11.6 \leq W_W+2.9W_{Mo}$. This ensures that the γ phase is strong.

In an embodiment, the nickel-based alloy composition consists of, in weight percent, of 10.1% or more chromium, preferably 10.3% or more chromium, more preferably of 10.5% or more chromium. This provides even better oxidation/corrosion resistance.

In an embodiment, the nickel-based alloy composition consists of, in weight percent, of 11.0% or less chromium. This minimises the risk of TCP phase formation.

In an embodiment, the nickel-based alloy composition consists of, in weight percent, of 0.3% or more molybdenum, preferably 0.5% or more molybdenum, more preferably 1.0% or more molybdenum. This allows a stronger gamma matrix to be achieved as well as allowing a higher level of chromium thereby to achieve good oxidation/corrosion resistance without increasing the chance of TCP phase formation.

In an embodiment, the nickel-based alloy composition consists of, in weight percent, of 3.0% or less molybdenum, preferably 2.8% or less molybdenum, more preferably 2.5% or less molybdenum. This achieves a good balance between solid solution strengthening and oxidation/corrosion resistance.

In an embodiment, the nickel-based alloy composition consists of, in weight percent, of 2.5% or less titanium, preferably 2.0% or less titanium, more preferably 1.8% or less titanium, most preferably 1.6% or less titanium. This limiting of the amount of titanium results in the best combination of strength and oxidation resistance.

In an embodiment, the nickel-based alloy composition consists of, in weight percent, of 22.6% or less cobalt. This produces an alloy with a good balance of cost, solid solution strengthening of the matrix and creep resistance. Reducing cobalt even further reduces the cost so that in an embodiment, the nickel-based alloy composition consists of, in weight percent, of 17.0% or less cobalt, preferably 15.0% or less cobalt.

In an embodiment the nickel-based alloy composition consists of, in weight percent, of 0.3% or more cobalt, preferably 0.6% or more cobalt, more preferably 7.0% or more or 7.5% or more cobalt, most preferably 9.2% or more cobalt. This results in an alloy with good creep resistance at the expense of increased cost.

In an embodiment, the nickel-based alloy composition consists of, in weight percent, of 0.2% or less hafnium. This is beneficial for tying up incidental impurities in the alloy and for providing strength.

In an embodiment, the nickel-based alloy composition consists of, in weight percent, of 2.9% or more tungsten. Increasing the minimum amount of tungsten results in better creep resistance.

In an embodiment, the nickel-based alloy composition consists, in weight percent, of 0.5% or less tantalum, preferably of 0.1% or less tantalum. Keeping the tantalum level low is advantageous as tantalum is very expensive compared to other elements which can take its place.

In an embodiment, the nickel-based alloy composition consists, in weight percent, of 4.4% or more aluminium, preferably of 4.5% or more aluminium, more preferably of 4.8% or more aluminium. Raising the level of aluminium achieves the desired γ' volume fraction without needing to use vast quantities of tantalum and thereby helps maintain the cost of the alloy low.

In an embodiment, the sum of elements cobalt, tungsten and molybdenum in weight percent is 11.2% or greater, preferably 18.1% or greater, more preferably 19.8% or greater. Increasing the sum of the elements cobalt, tungsten and molybdenum results in greater creep resistance.

In an embodiment, the sum of elements cobalt, tungsten and molybdenum is 26.6% or less, preferably 20.1% or less, more preferably 17.1% or less and most preferably 12.6% or less. This allows the niobium and cobalt concentration to be kept low and thereby achieves a lower cost alloy whilst maintaining mechanical properties.

In an embodiment, the nickel-based alloy composition consists of, in weight percent, of 0.1% or more iron. This is preferred as it allows the alloy to be manufactured from recycled metals.

In an embodiment, the nickel-based alloy composition consists of in weight percent, of 8.0% or less iron, preferably 1.0% or less iron. This is preferred to reduce the propensity to form the unwanted Laves phase which can degrade the mechanical properties of the alloy.

In an embodiment, the sum of elements molybdenum and tungsten, in weight percent, is 10.6% or less, preferably 9.9% or less. This ensures the required level of microstructural stability given the chromium content.

In an embodiment, the sum of elements molybdenum and tungsten, in weight percent is 3.2% or more, preferably 3.6% or more, more preferably 4.0% or more. This allows the alloy to achieve a strong γ matrix phase and a suitable level of creep resistance.

In an embodiment, the nickel-based alloy composition consists, in weight percent, of 6.8% or less aluminium, preferably 6.7% or less aluminium. This allows a high strength to be achieved through a suitable fraction of γ' being present.

In an embodiment, the following equation is satisfied in which $W_{Nb}$, $W_{Ta}$ and $W_{Ti}$ are the weight percent of niobium, tantalum and titanium in the alloy respectively $W_{Nb}+W_{Ta}+W_{Ti}\geq 2.6$, preferably $W_{Nb}+W_{Ta}+W_{Ti}\geq 3.1$, more preferably $W_{Nb}+W_{Ta}+W_{Ti}\geq 3.2$, most preferably $W_{Nb}+W_{Ta}+W_{Ti}\geq 3.6$. This allows a suitable amount of γ' to be present combined with a high anti-phase boundary energy thereby achieving the desired strength.

In an embodiment, the ratio of the sum of the elements niobium, tantalum and titanium to aluminium by weight percent is greater than 0.45, preferably greater than 0.55, most preferably greater than 0.65. This achieves the desired combination of γ' fraction and anti-phase boundary energy providing strength.

In an embodiment, the nickel-based alloy composition consists, in weight percent, of 3.0% or less niobium. This further reduces the cost of the alloy.

In an embodiment, the nickel-based alloy composition consists, in weight percent, of 0.5 wt. % or more titanium. This helps achieve the desired γ' volume fraction without having to increase the levels of niobium and tantalum.

In an embodiment, the nickel-based alloy composition consist, in weight percent, of 10.6% or less tungsten, preferably 8.0 wt. % or less tungsten. Such an alloy has reduced density.

In an embodiment, the nickel-based alloy composition has between 55% and 70% volume fraction γ', preferably between 58% and 70% volume fraction γ'. This provides the preferred balance between creep resistance, oxidation resistance and propensity to form TCP phases.

In an embodiment, a turbine wheel formed of the nickel-based alloy composition of any of the preceding claims.

In an embodiment, an exhaust gas turbocharger device comprises such a turbine wheel.

In an embodiment, a cast article is formed of the nickel-based alloy composition.

The term "consisting of" is used herein to indicate that 100% of the composition is being referred to and the presence of additional components is excluded so that percentages add up to 100%. Unless otherwise stated, percents are expressed in weight percent.

The invention will be more fully described, by way of example only, with reference to the accompanying drawings in which.

Figure 1:
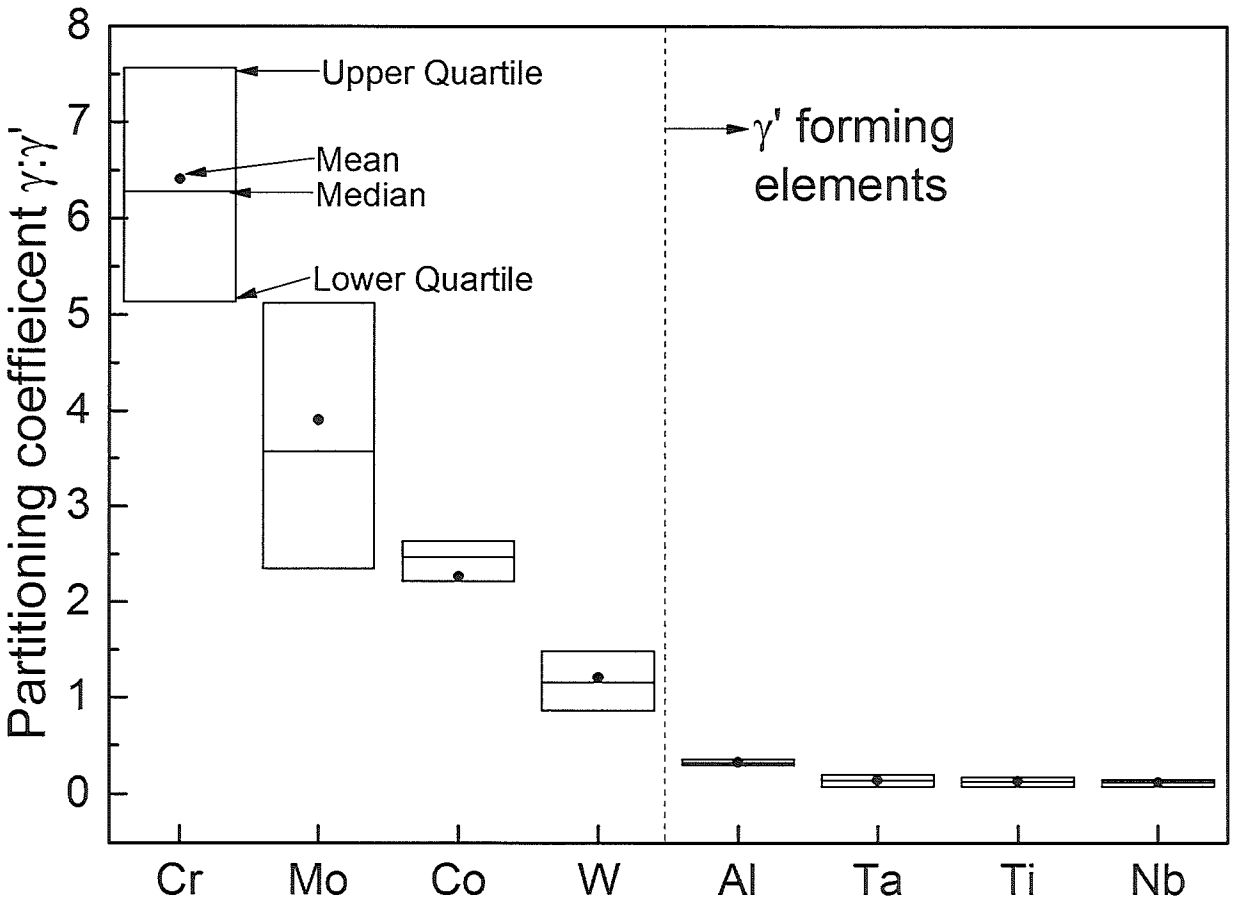
FIG. 1 shows the partitioning coefficient for the main components in the alloy design space.

Traditionally, nickel-based superalloys have been designed through empiricism. Thus their chemical compositions have been isolated using time consuming and expensive experimental development, involving small-scale processing of limited quantities of material and subsequent characterisation of their behaviour. The alloy composition adopted is then the one found to display the best, or most desirable, combination of properties. The large number of possible alloying elements indicates that these alloys are not entirely optimised and that improved alloys are likely to exist.

In superalloys, generally additions of chromium (Cr) and aluminium (Al) are added to impart resistance to oxidation/corrosion, cobalt (Co) is added to improve resistance to sulphidisation. For creep resistance, molybdenum (Mo), tungsten (W), cobalt are introduced, because these retard the thermally-activated processes—such as, dislocation climb—which determine the rate of creep deformation. To promote static and cyclic strength, aluminium (Al), tantalum (Ta), niobium (Nb) and titanium (Ti) are introduced as these promote the formation of the precipitate hardening phase gamma-prime (γ'). This precipitate phase is coherent with the face-centered cubic (FCC) matrix phase which is referred to as gamma (γ).

A modelling-based approach used for the isolation of new grades of nickel-based superalloys is described here, termed the "Alloys-By-Design" (ABD) method. This approach utilises a framework of computational materials models to estimate design relevant properties across a very broad compositional space. In principle, this alloy design tool allows the so called inverse problem to be solved; identifying optimum alloy compositions that best satisfy a specified set of design constraints.

The first step in the design process is the definition of an elemental list along with the associated upper and lower compositional limits. The compositional limits for each of the elemental additions considered in this invention—referred to as the "alloy design space"—are detailed in Table 2.

TABLE 2

Alloys design space in wt. % searched using the "Alloys-by-Design" method.

| Alloy (wt. %) | Al | Co | Cr | Mo | Nb | Ta | Ti | W |
|---|---|---|---|---|---|---|---|---|
| Min | 4.0 | 0.0 | 8.0 | 0.0 | 0.0 | 0.0 | 0.0 | 0.0 |
| Max | 8.0 | 25.0 | 16.0 | 8.0 | 4.0 | 4.0 | 4.0 | 12.0 |

The balance is nickel. The levels of carbon, boron and zirconium where fixed at 0.06%, 0.015% and 0.06% respectively.

The second step relies upon thermodynamic calculations used to calculate the phase diagram and thermodynamic properties for a specific alloy composition. Often this is referred to as the CALPHAD method (CALculate PHAse Diagram). These calculations are conducted at the typical service temperature for the new alloy (900° C.), providing information about the phase equilibrium (microstructure).

A third stage involves isolating alloy compositions which have the desired microstructural architecture. In the case of nickel based superalloys which require superior resistance to creep deformation, the creep rupture life generally improves as the volume fraction of the precipitate hardening phase γ' is increased, the most beneficial range for volume fraction of γ' lies between 60%-70%. At values above 70% volume fraction of γ' a drop in creep resistance is observed.

It is also necessary that the γ/γ' lattice misfit should conform to a small value, either positive or negative, since coherency is otherwise lost; thus limits are placed on its magnitude. The lattice misfit δ is defined as the mismatch between γ and γ' phases, and is determined according to $$\delta = \frac{2(a_{\gamma'} - a_{\gamma})}{a_{\gamma'} + a_{\gamma}} \tag{1}$$

where $a_{\gamma}$ and $a_{\gamma'}$ are the lattice parameters of the γ and γ' phases.

Rejection of alloy on the basis of unsuitable microstructural architecture is also made from estimates of susceptibility to topologically close-packed (TCP) phases. The present calculations predict the formation of the deleterious TCP phases sigma (σ), P and mu (μ) using CALPHAD modelling.

Thus the model isolates all compositions in the design space which are calculated to result in a desired volume fraction of γ', which have a lattice misfit γ' of less than a predetermined magnitude and have a total volume fraction of TCP phases below a predetermined magnitude.

In the fourth stage, merit indices are estimated for the remaining isolated alloy compositions in the dataset. Examples of these include: creep-merit index (which describes an alloy's creep resistance based solely on mean composition), strength-merit index (which describes an alloy's precipitation yield strength based solely on mean composition), solid-solution merit index (which describes an alloy's solid solution yield strength based solely on mean composition), density and cost.

In the fifth stage, the calculated merit indices are compared with limits for required behaviour, these design constraints are considered to be the boundary conditions to the problem. All compositions which do not fulfil the boundary conditions are excluded. At this stage, the trial dataset will be reduced in size quite markedly.

The final, sixth stage involves analysing the dataset of remaining compositions. This can be done in various ways. One can sort through the database for alloys which exhibit maximal values of the merit indices—the lightest, the most creep resistant, the most oxidation resistant, and the cheapest for example. Or alternatively, one can use the database to determine the relative trade-offs in performance which arise from different combination of properties.

The example five merit indicies are now described.

The first merit index is the creep-merit index. The overarching observation is that time-dependent deformation (i.e. creep) of a nickel-based superalloy occurs by dislocation creep with the initial activity being restricted to the γ phase. Thus, because the fraction of the γ' phase is large, dislocation segments rapidly become pinned at the γ/γ' interfaces. The rate-controlling step is then the escape of trapped configurations of dislocations from γ/γ' interfaces, and it is the dependence of this on local chemistry—in this case composition of the γ phase—which gives rise to a significant influence of alloy composition on creep properties.

A physically-based microstructure model can be invoked for the rate of accumulation of creep strain $\dot{\varepsilon}$ when loading is uniaxial and along the ⟨001⟩ crystallographic direction. The equation set is $$\dot{\varepsilon}_{\langle 001\rangle} = \frac{16}{\sqrt{6}}\rho_m\phi_p D_{eff}(1-\phi_p)(1/\phi_p^{1/3}-1)\sinh\left\{\frac{\sigma b^2\omega}{\sqrt{6}\,K_{CF}kT}\right\} \tag{2}$$

$$\dot{\rho}_m = C\dot{\varepsilon}_{\langle 001\rangle} \tag{3}$$

where $\rho_m$ is the mobile dislocation density, $\phi_p$ is the volume fraction of the γ' phase, and ω is width of the matrix channels. The terms σ and T are the applied stress and temperature, respectively. The terms b and k are the Burgers vector and Boltzmann constant, respectively. The term $K_{CF}=1+2\phi_p^{1/3}/3\sqrt{3\pi}\,(1-\phi_p^{1/3})$ is a constraint factor, which accounts for the close proximity of the cuboidal particles in these alloys. Equation 3 describes the dislocation multiplication process which needs an estimate of the multiplication parameter C and the initial dislocation density. The term $D_{eff}$ is the effective diffusivity controlling the climb processes at the particle/matrix interfaces.

Note that in the above, the composition dependence arises from the two terms $\phi_p$ and $D_{eff}$. Thus, provided that the microstructural architecture is assumed constant (microstructural architecture is mostly controlled by heat treatment) so that $\phi_p$ is fixed, any dependence upon chemical composition arises through $D_{eff}$. For the purposes of the alloy design modelling described here, it turns out to be unnecessary to implement a full integration of Equations 2 and 3 for each prototype alloy composition. Instead, a first order merit index $M_{creep}$ is employed which needs to be maximised, which is given by $$M_{creep} = \sum_i x_i/\tilde{D}_i \tag{4}$$

where $x_i$ is the atomic fraction of solute i in the γ phase and $\tilde{D}_i$ is the appropriate interdiffusion coefficient.

The second merit index is for strength merit index. For high nickel-based superalloys, the vast majority of strength comes from the precipitate phase. Therefore, optimising alloy composition for maximal precipitate strengthening is a critical design consideration. From hardening theory a merit index for strength, $M_{strength}$, is proposed. The index considers the maximum possible precipitate strength—determined to be the point where the transition from weakly coupled to strongly coupled dislocation shearing occurs—which can be approximated using, $$M_{strength}=\overline{M}\cdot\tfrac{1}{2}\gamma_{APB}\phi_p^{1/2}/b \quad (5)$$

Where $\overline{M}$ is the Taylor factor, $\gamma_{APB}$ is the anti-phase boundary (APB) energy, $\phi_p$ is the volume fraction of the γ' phase and b is the Burgers vector.

From Equation 5 it is apparent that fault energies in the γ' phase—for example, the anti-phase boundary APB energy—have a significant influence on the deformation behaviour of nickel-based superalloys. Increasing the APB energy has been found to improve mechanical properties including, tensile strength and resistance to creep deformation. The APB energy was studied for a number of Ni—Al—X systems using density functional theory. From this work the effect of ternary elements on the APB energy of the γ' phase was calculated, linear superposition of the effect for each ternary addition was assumed when considering complex multicomponent systems, resulting in the following equation, $$\gamma_{APB}=195-1.7x_{Cr}-1.7x_{Mo}+4.6x_{W}+27.1x_{Ta}+21.4x_{Nb}+15x_{Ti} \quad (6)$$

where, $x_{Cr}$, $x_{Mo}$, $x_{W}$, $x_{Ta}$, $x_{Nb}$ and $x_{Ti}$ represent the concentrations, in atomic percent, of chromium, molybdenum, tungsten, tantalum, niobium and titanium in the γ' phase, respectively. The composition of the γ' phase is determined from phase equilibrium calculations.

The third merit index is solid solution merit index. Solid solution hardening occurs in (FCC) matrix phase which is referred to as gamma (γ), in particular this hardening mechanism is important at high temperatures. A model which assumes superposition of individual solute atoms on the strengthening of the matrix phase is employed. The solid solution strengthening coefficients, $k_i$, for the elements considered in the design space: aluminium, cobalt, chromium, molybdenum, niobium, tantalum, titanium and tungsten are 225, 39.4, 337, 1015, 1183, 1191, 775 and 977 MPa/at. $\%^{1/2}$, respectively. The solid-solution index is calculated based upon the equilibrium composition of the matrix phase using the following equation, $$M_{solid\text{-}solution}=\Sigma_i(k_i^2\sqrt{x_i}) \quad (7)$$

where, $M_{solid\text{-}solution}$ is the solid solution merit index and $x_i$ is the concentration of element i in the γ matrix phase.

The fourth merit index is density. The density, ρ, was calculated using a simple rule of mixtures and a correctional factor, where, $\rho_i$ is the density for a given element and $x_i$ is the atomic fraction of the alloy element.

$$\rho=1.05[\Sigma_i x_i\rho_i] \quad (8)$$

The fifth merit index was cost. In order to estimate the cost of each alloy a simple rule of mixtures was applied, where the weight fraction of the alloy element, $x_i$, was multiplied by the current (2016) raw material cost for the alloying element, $c_i$.

$$\text{Cost}=\Sigma_i x_i c_i \quad (9)$$

The estimates assume that processing costs are identical for all alloys, i.e. that the product yield is not affected by composition.

The ABD method described above was used to isolate the inventive alloy composition. The design intent for this alloy was to optimise the composition of a conventionally cast nickel-based superalloy composition for tensile strength and creep resistance equivalent to the Mar-M246 and Mar-M247 alloy grades. These mechanical properties are achieved in combination with a reduction in alloy cost and an improvement in oxidation/corrosion resistance in comparison to the M246 and Mar-M247 alloy grades.

The material properties—determined using the ABD method—for the typical compositions of conventionally cast nickel-based alloys, listed in Table 1, are listed in Table 3. The design of the new alloy was considered in relation to the predicted properties listed for these alloys.

The rationale for the design of the new alloy is now described.

TABLE 3

Calculated phase fractions and merit indices made with the "Alloys-by-Design" software. Results for nickel-based superalloys listed in Table 1.

| | Phase Fractions | | Creep Merit Index | Density | Cost | γ/γ' Misfit | HTW | Strength Merit Index | Solid Solution Merit Index |
|---|---|---|---|---|---|---|---|---|---|
| Alloy | γ' | σ + μ + P | ($m^{-2}s \times 10^{-15}$) | (g/cm³) | ($/lb) | (%) | (° C.) | (Mpa) | (Mpa) |
| IN713C | 0.54 | 0.00 | 2.89 | 7.97 | 9.9 | −0.40 | 133 | 1133 | 89 |
| IN713LC | 0.52 | 0.00 | 2.57 | 8.03 | 10.0 | −0.25 | 145 | 1110 | 84 |
| Mar-M246 | 0.59 | 0.03 | 7.34 | 8.51 | 11.9 | −0.35 | 150 | 1246 | 90 |
| Mar-M247 | 0.58 | 0.00 | 7.52 | 8.60 | 13.1 | −0.16 | 141 | 1279 | 85 |

Optimisation of the alloy's microstructure—primarily comprised of an austenitic face centre cubic (FCC) gamma phase (γ) and the ordered $L1_2$ precipitate phase (γ')—was required to maximise creep resistance. In the case of nickel-based superalloys which require superior resistance to creep deformation, the creep rupture life generally improves as the volume fraction of the precipitate hardening phase γ' is increased. At values above 70% volume fraction of γ' a drop in creep resistance is observed. A volume fraction of γ' of 55% or greater was desired to produce an alloy with creep rupture life greater than that of IN713C and IN713LC, preferably a volume fraction of γ' is greater than or equal to 58% so that creep resistance equivalent to or better than Mar-M246 and Mar-M247 is achieved.

The partitioning coefficient for each element included in the alloy design space was determined from phase equilibrium calculations conducted at 900° C., FIG. 1. A partitioning coefficient of unity describes an element with equal preference to partition to the γ or γ' phase. A partitioning coefficient less than unity describes an element which has a preference for the γ' phase, the closer the value to zero the stronger the preference. The greater the value above unity the more an element prefers to reside within the γ phase. The partitioning coefficients for aluminium, tantalum, titanium and niobium show that these are strong γ' forming elements.

The elements chromium, molybdenum, cobalt, and tungsten partition preferably to the γ phase. For the elements considered within the alloy design space aluminium, tantalum, titanium and niobium partition most strongly to the γ' phase. Hence, aluminium, tantalum, titanium and niobium levels were controlled to produce the desired γ' volume fraction.

Figure 2:
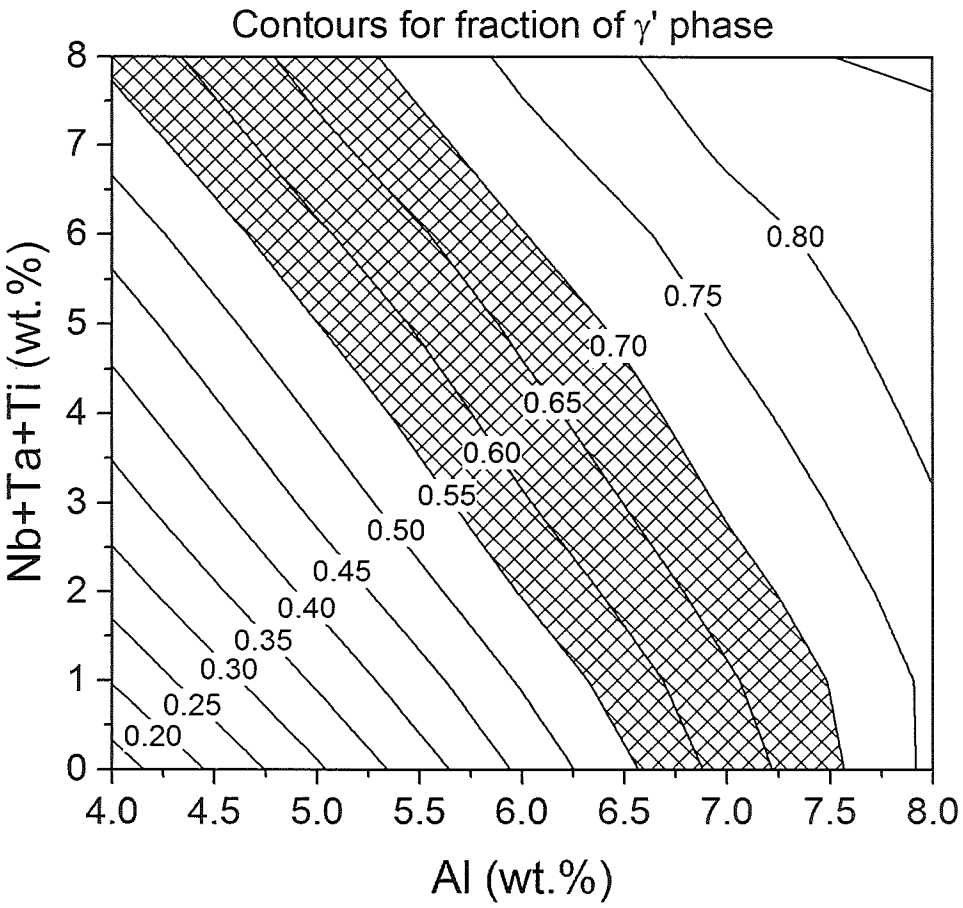
FIG. 2 is a contour plot showing the effect of γ' forming elements aluminium and the sum of elements niobium, tantalum and titanium on volume fraction of γ' for alloys within the alloy design space, determined from phase equilibrium calculations conducted at 900° C.

FIG. 2 shows the effect which elements added to form the γ' phase—predominantly aluminium, tantalum, titanium and niobium—have on the fraction of γ' phase in the alloy at the operation temperature, 900° C. in this instance. The sum of the elements niobium, tantalum and titanium (Nb+Ta+Ti) has been considered as these elements are typically added to substitute for aluminium atoms in the γ' phase, such that the γ' phase is of composition $Ni_3(Al,Ti,Ta,Nb)$. The elements niobium, tantalum and titanium increase the anti-phase boundary (APB) energy of the γ' phase (Equation 6) having the technical effect of increasing the overall strengthening provided by the precipitate phase (Equation 5). Increasing the APB energy is beneficial for both tensile strength and creep resistance. For the design of this alloy a volume fraction of γ' between 55-70% was desired. Hence up to 7.6 weight percent (wt. %) of aluminium can be added to produce this volume fraction of γ' phase.

The change in γ' volume fraction was related to the change in aluminium and the sum of the elements niobium, tantalum and titanium content according to the formula $$f(\gamma')=(W_{Nb}+W_{Ta}+W_{Ti})+3.2W_{Al}$$

where, f(γ') is a numerical value which ranges between 19.0 and 24.5 for an alloy with the desired γ' fraction, between 0.55 and 0.70 in this case, and $W_{Nb}$, $W_{Ta}$, $W_{Ti}$ and $W_{Al}$ are the weight percent of sum of the elements niobium, tantalum, titanium, and aluminium in the alloy respectively. More preferably f(γ') is a numerical value which is greater than 20.0 as this produces and alloy with the a preferred γ' fraction between 0.58 and 0.70.

Optimisation of aluminium, tantalum, titanium and niobium additions was also required to increase the yield stress of the alloy, predicted by the strength merit index (Equation 5). For turbocharger applications, where the turbine disc is rotating at a high speed and high temperature, a high yield stress is critical to be ensure resistance to disc burst. The current alloy compositions used have a strength merit index of ~1120 MPa for alloys IN713C and IN713LC and ~1260 MPa for alloys Mar-M246 and Mar-M247. A minimum strength merit index of 1200 MPa was desired such that the alloy will have a strength greater than IN713C and IN713LC. Preferably the target was to design an alloy with a strength merit index of 1250 MPa so that yield stress was equivalent to Mar-M246 and Mar-M247, most preferably the strength merit index should be greater than 1300 MPa so that the yield stress is greater than all currently used alloys.

Figure 3:
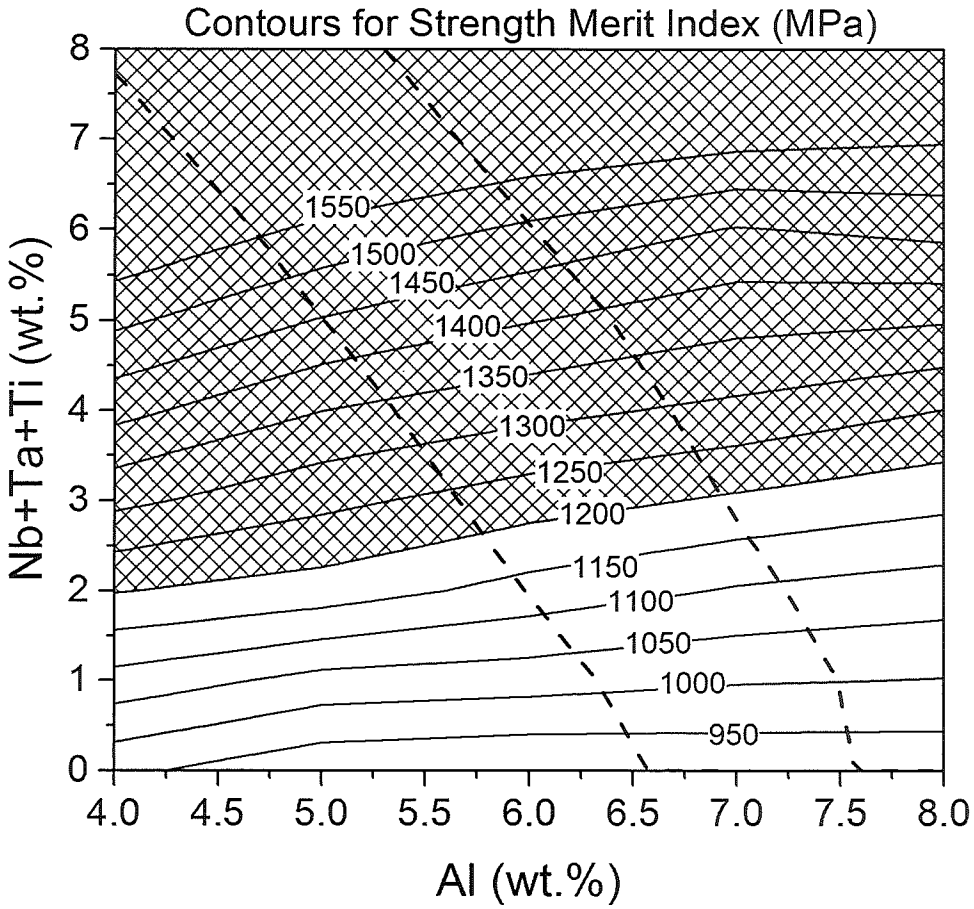
FIG. 3 is a contour plot showing the effect of elements aluminium and the sum of elements niobium, tantalum and titanium on yield strength (in terms of strength merit index), superimposed are limits for volume fraction of γ' between 55-70% taken from FIG. 2.

FIG. 3 shows the influence of aluminium and sum of the elements niobium, tantalum and titanium on the strength merit index. Dotted lines—taken from FIG. 2—are also superimposed, these identified the bounding limits for the required volume fraction of γ' (55-70%). Modelling calculation showed that for alloys with a volume fraction of γ' between 55-70% the sum of the elements niobium, tantalum and titanium must be greater than 2.6 wt. %, and the ratio of sum of the elements niobium, tantalum and titanium to aluminium by weight percent is greater than 0.45 (Nb+Ta+Ti/Al≥0.45), producing an alloy with a strength merit index of at least 1200 MPa. More preferably the sum of the elements niobium, tantalum and titanium must be greater than 3.1 wt. % and the ratio of sum of the elements niobium, tantalum and titanium to aluminium by weight percent is greater than 0.55 (Nb+Ta+Ti/Al≥0.55). Most preferably the sum of the elements niobium, tantalum and titanium must be greater than 3.6 wt. %, and the ratio of sum of the elements niobium, tantalum and titanium to aluminium by weight percent is greater than 0.65 (Nb+Ta+Ti/Al≥0.65), producing an alloy with a strength merit index of 1300 MPa or better.

The minimum ratio for the sum of elements tantalum, titanium and niobium to aluminium of 0.45 by weight percent results in aluminium additions being limited to a maximum of 6.9 wt. % so that the desired γ' volume fraction and strength merit index can be achieved (FIG. 3). More preferably aluminium content should be limited to 6.8 wt. % so that a strength merit index of at least 1250 MPa is achieved, even more preferably the aluminium content should be limited to 6.7 wt. % so that a strength merit index of at least 1300 MPa is achieved.

Too high a level of titanium leads to concerns about the oxidation resistance of the alloy. Therefore titanium is limited to 3.0 wt. %. At this level oxidation resistance is acceptable whilst the alloy will have good strength. Preferably titanium is limited to 2.5 wt. % or less which gives a better combination of strength and oxidation resistance. In order to produce an alloy which has an even better combination of strength and oxidation resistance preferably the additions of titanium are limited to less than 2.0 wt. %. This limits the formation of titanium oxides which are not a protective oxide scales and may be deleterious to the oxidation performance of the alloy. More preferably it is necessary to limit the additions of titanium to less than 1.8 wt. %. The best combination of strength and oxidation resistance is attained when additions of titanium are limited to 1.6 wt. % or less.

The maximum tantalum and niobium content will be explained below with reference to FIGS. 5-7. This results in a tantalum range of up to 1.0 wt. %, a preferred range of up to 0.5 wt. %, or a more preferred range of up to 0.1 wt. %. The niobium range is limited to between 0.6 and 3.7 wt. % this results in a desirable combination of cost, strength and creep resistance (dealt with below). From FIG. 2 it is seen that when the maximum concentrations of titanium (3.0 wt. %), tantalum (1.0 wt. %) and niobium (3.7 wt. %) are added, such that the sum of the elements tantalum, titanium and niobium is equal to 7.7 wt. % then to produce the desired volume fraction of γ' a minimum of 4.0 wt. % aluminium is required. Therefore, an aluminium concentration of between 4.0 and 6.9 wt. % is required to achieve the desired γ' volume fraction. An increase in concentration of aluminium to 4.4 wt. % or more increases the γ' volume thereby resulting in higher strength. The increase in the minimum amount of aluminium concentration of 4.4 wt. % or more is particularly desirable if the amount of titanium is limited to 2.5 wt. % or 2.0 wt. % or less. More preferably when the titanium is limited to 1.8% and 1.6% the preferred minimum aluminium content is 4.5% to produce the desired volume fraction of γ'. Even more preferably when the tantalum content is less the 0.1% the preferred minimum aluminium content is 4.8 wt. % to produce the desired volume fraction of γ'.

As previously described the yield stress and creep resistance of the alloy is increased by controlling the γ' volume fraction and strength merit index. Further improvements in strength can be achieved by adding elements which partition to the face-centered cubic (FCC) matrix phase which is referred to as gamma (γ). The influence of elements on the strength of the γ phase is calculated using the solid solution merit index (SSI). The γ phase of the current invention is primarily composed of the elements, molybdenum, cobalt, chromium and tungsten. Chromium does not strongly effect solid solution strengthening of the γ phase and is added primarily increase the oxidation and corrosion resistance of the alloy. Cobalt does not strongly effect solid solution strengthening of the γ phase but has a beneficial effect upon the creep merit index, described in FIG. 15. The elements molybdenum and tungsten were found to most strongly effect the solid solution index.

Figure 4:
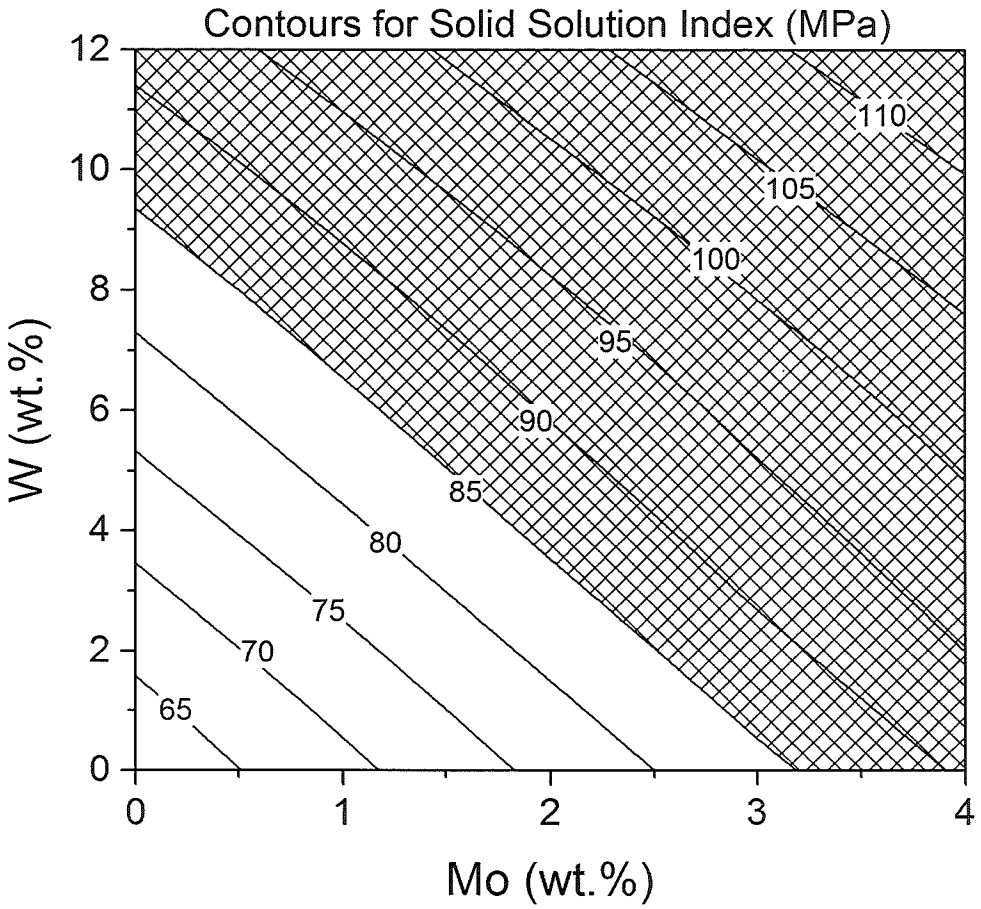
FIG. 4 is a contour plot showing the effect molybdenum and tungsten on solid solution strengthening (in terms of solid solution index), for alloys with a volume fraction of γ' between 55-70%.

The effect of molybdenum and tungsten on the solid solution index is described in FIG. 4. A minimum target for the solid solution index was 85 MPa, more preferably the minimum target was 90 MPa. The change in solid solution index was related to the change in tungsten and molybdenum content according to the formula $$f(SSI)=W_W+2.9W_{Mo}$$

where, f(SSI) is a numerical value, and $W_W$ and $W_{Mo}$ are the weight percent of tungsten and molybdenum in the alloy respectively. The numerical value for f(SSI) should be greater than or equal to 9.4 in order to produce a value for SSI of at least 85 MPa, equivalent to alloys Mar-M246 and IN713LC. Preferably the numerical value for f(SSI) is greater than or equal to 11.6 to produce an alloy with a value for SSI of at least 90 MPa, equivalent to alloys IN713C and Mar-M246.

The current (2016) raw material cost for the element tantalum is substantial higher than other elements in the invention and has the most significant effect on alloy cost. The element niobium is also expensive, but substantially lower cost than tantalum. Niobium has the same technical effect as tantalum, as determined by calculations for the strength merit index and γ' volume fraction; thus, preference for niobium over tantalum produces an improved balance of strength and cost. The elements cobalt, tungsten and molybdenum are of approximately similar cost, however, they are still more costly than nickel and thus increase alloy cost. The elements aluminium, titanium and chromium do not have the effect of increasing alloy cost. Titanium is desirably present in an amount of 0.5 wt % or more as it increases γ' formation at lower cost than niobium or tantalum.

Figure 5:
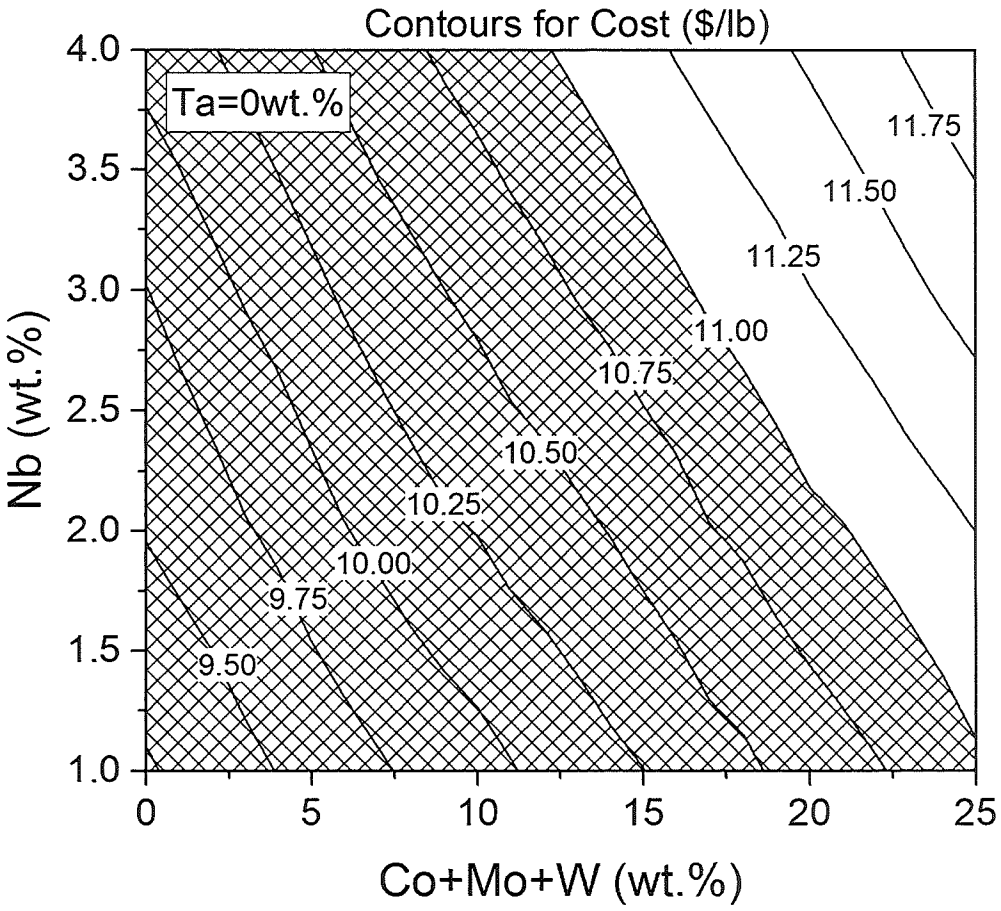
FIG. 5 is a contour plot showing the effect of niobium and the sum of elements cobalt, molybdenum and tungsten on raw material cost for alloys with a volume fraction of γ' between 55-70% when tantalum content is fixed at 0 wt. %.
Figure 6:
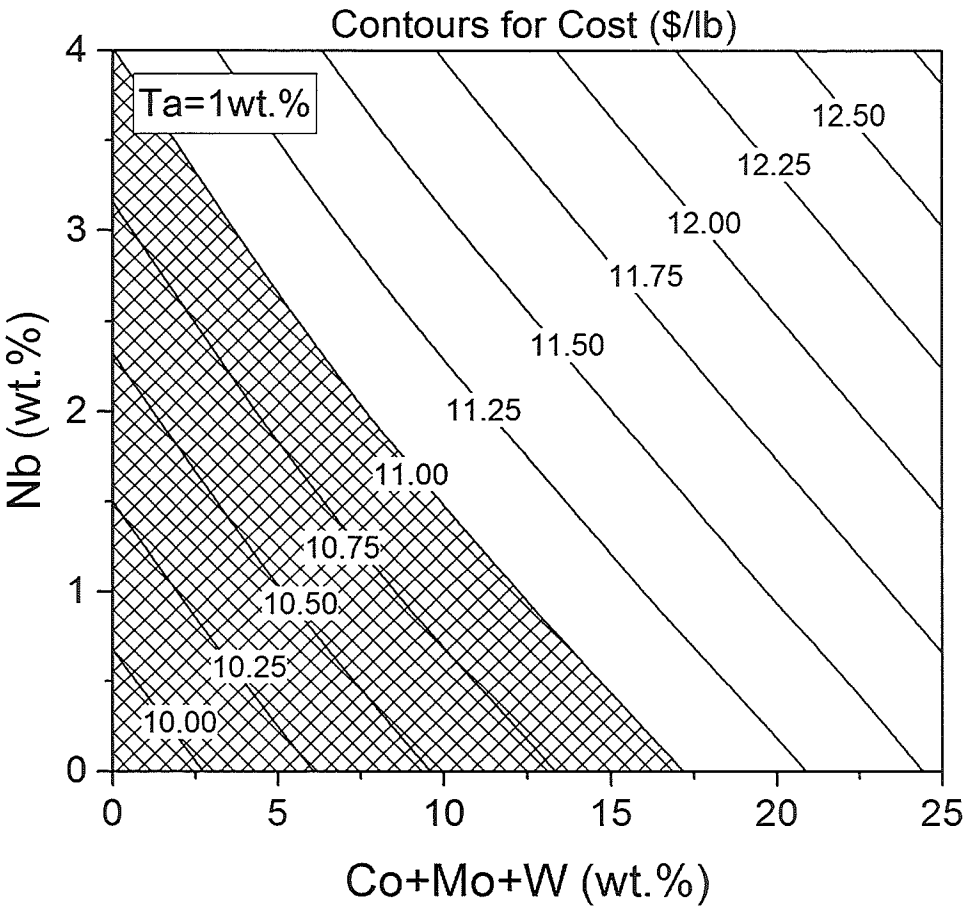
FIG. 6 is a contour plot showing the effect of niobium and the sum of elements cobalt, molybdenum and tungsten on raw material cost for alloys with a volume fraction of γ' between 55-70% when tantalum content is fixed at 1 wt. %.
Figure 7:
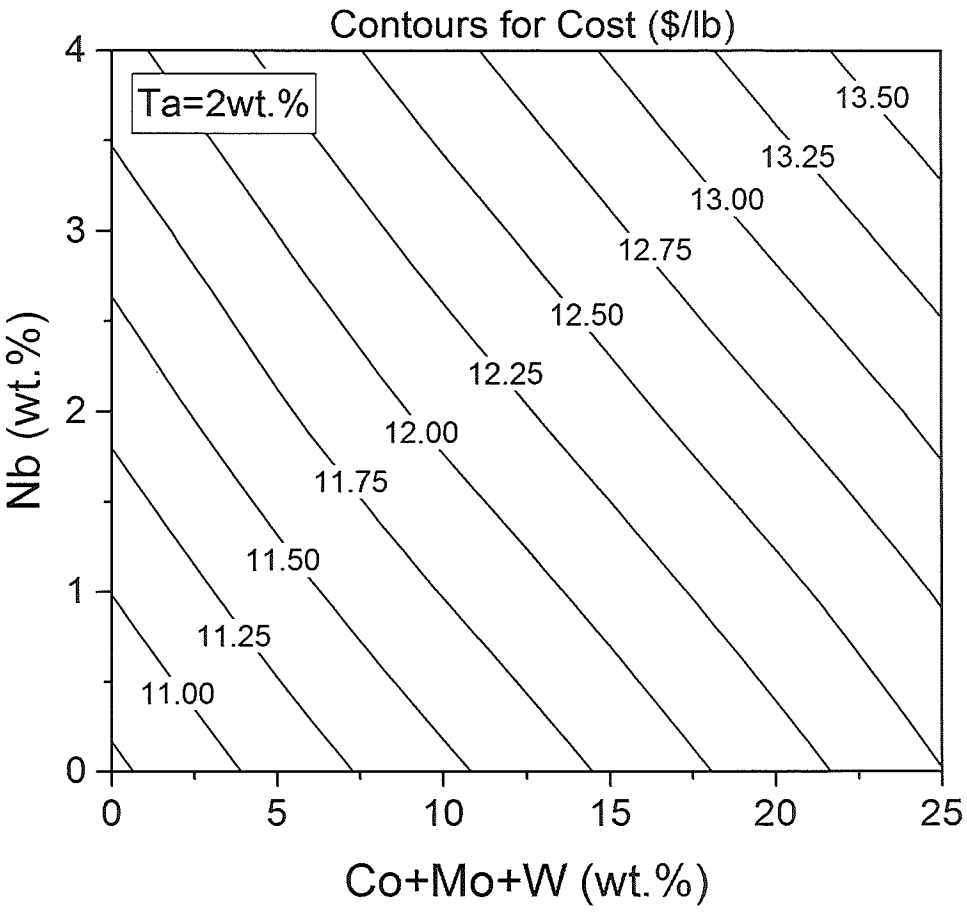
FIG. 7 is a contour plot showing the effect of niobium and the sum of elements cobalt, molybdenum and tungsten on raw material cost for alloys with a volume fraction of γ' between 55-70% when tantalum content is fixed at 2 wt. %.

FIGS. 5-7 presents the effect of elements tantalum, niobium and the sum of the elements cobalt, tungsten and molybdenum on alloy cost. The target for the invention was to have a cost of 11 $/lb, which is substantially lower than the Mar-M247 alloy and lower than Mar-M246 alloy. Preferably a cost which is less than 10.5 $/lb is desired, more preferably a cost of 10 $/lb is desired as this is equivalent to IN713C and IN713LC. Tantalum has the strongest influence on alloy cost, FIGS. 6-7. When tantalum is at 2 wt. % the required cost target cannot be satisfied (FIG. 7), therefore tantalum is required to be less than 2 wt. %.

If the minimum required sum of the elements cobalt, tungsten and molybdenum is greater than or equal to 11.2 wt. % (Co+Mo+W≥11.2 wt. %) an acceptable creep resistance is achieved; explained below with reference to FIG. 15. Further improvements in creep are attained when the sum of the elements cobalt, tungsten and molybdenum is increased beyond 11.2 wt. %, most preferably the sum of the elements cobalt, tungsten and molybdenum is greater than 19.8 wt. % as this produces and alloy with a creep merit index equal to or better than Mar-M246 and Mar-M247. When the level of the tantalum in the alloy is at 1 wt. %, (FIG. 6) the maximum concentration of the sum of the elements cobalt, tungsten and molybdenum is limited to 17.1 wt. % to meet the alloy's cost target. When the percentage of tantalum is reduced to less than 1.0% more preferably less than 0.1 wt. % an improved balance of creep resistance and alloy cost is attained, FIG. 5.

If the tantalum concentration in the alloy is limited to 0.1 wt. % the resulting minimum niobium concentration must be 0.6 wt. %, if (Nb+Ta+Ti≥2.6 wt. %) is to be satisfied. To achieve the cost target of less than or equal to 11 $/lb at a niobium concentration of 0.6 wt. % the sum of the elements cobalt, tungsten and molybdenum must be less than or equal to 26.6 wt. %. More preferably the sum of the cobalt, tungsten and molybdenum must be less than or equal to 20.1 wt. % to produce an alloy with a cost lower than 10.5 $/lb, even more preferably less than or equal to 12.6 wt. % to produce an alloy with a cost lower than 10.0 $/lb. Higher Nb up to 3.7 wt % or less increases strength and creep resistance but a level of 3.0 wt % or less niobium is preferred to keep cost of the alloy down.

Iron behaves in a similar way to nickel and can be added as a low cost alternative to nickel. Moreover tolerance to iron additions improves the ability of the alloy to be manufactured from recycled materials. Therefore, it is preferred that iron is present in an amount of at least 0.1 wt. %. However, additions of iron up to 10.0 wt. % can be made in order to substantially reduce the cost. Preferably the additions of iron are less than 8.0 wt. % in order to reduce the propensity to form the unwanted Laves phase which degrades the mechanical properties of the alloy. Most preferably iron additions are limited to 1 wt. % as this produces an alloy which has good ability to be recycled with no loss in material performance.

The addition of molybdenum, tungsten and chromium were found to increase the propensity to form unwanted TCP phases (FIG. 8-14); primarily σ, P and μ phases. Additions of molybdenum and tungsten are necessary for both solid solution strengthening (FIG. 4) as well as creep resistance (FIG. 15). In combination with improved solid solution strengthening and creep resistance a high level of resistance to corrosion/oxidation is required. Improvements in oxidation and corrosion resistance come from additions of chromium. Thus a complex trade-off between mechanical performance, oxidation/corrosion resistance and microstructural stability must be managed. The alloy of this invention requires a chromium content of greater than 9.1 wt. % ensuring that oxidation/corrosion is better than Mar-M246 and Mar-M247. More preferably the chromium content is greater than 10.1 wt. % as this provides even better oxidation/corrosion resistance. Even more preferably chromium is present in an amount of 10.3% or more or even 10.5% or more. This increases the oxidation/corrosion resistance even further. It is desired that the new alloy contains less than 1% volume fraction of TCP phases at equilibrium at 900° C., ensuring that the alloy is microstructurally stable.

FIGS. 8-14 shows the effect of tungsten and chromium additions on the overall fraction of TCP phases (σ+μ+P) for alloys containing different levels of molybdenum at equilibrium at 900° C. On each figure the minimum required tungsten content required to satisfy the constraint for solid solution strengthening, f(SSI), is delineated. It is seen that increasing the concentration of molybdenum limits the maximum concentration of chromium and tungsten if the alloy is to meet the requirements for limited TCP formation.

For alloys containing greater than 6 wt. % of molybdenum (FIG. 14) an alloy with the minimum desired chromium level is difficult to achieve. Additions of molybdenum of 5 wt. % makes it difficult to achieve the required f(SSI). When the molybdenum level is at 4 wt. % (FIG. 12) the required f(SSI) can be achieved and a chromium content of up to 11 wt. % can be achieved, providing good balance of oxidation/ corrosion resistance, solid solution strengthening and creep resistance. Therefore, molybdenum additions are limited to 4 wt. %.

Figure 12:
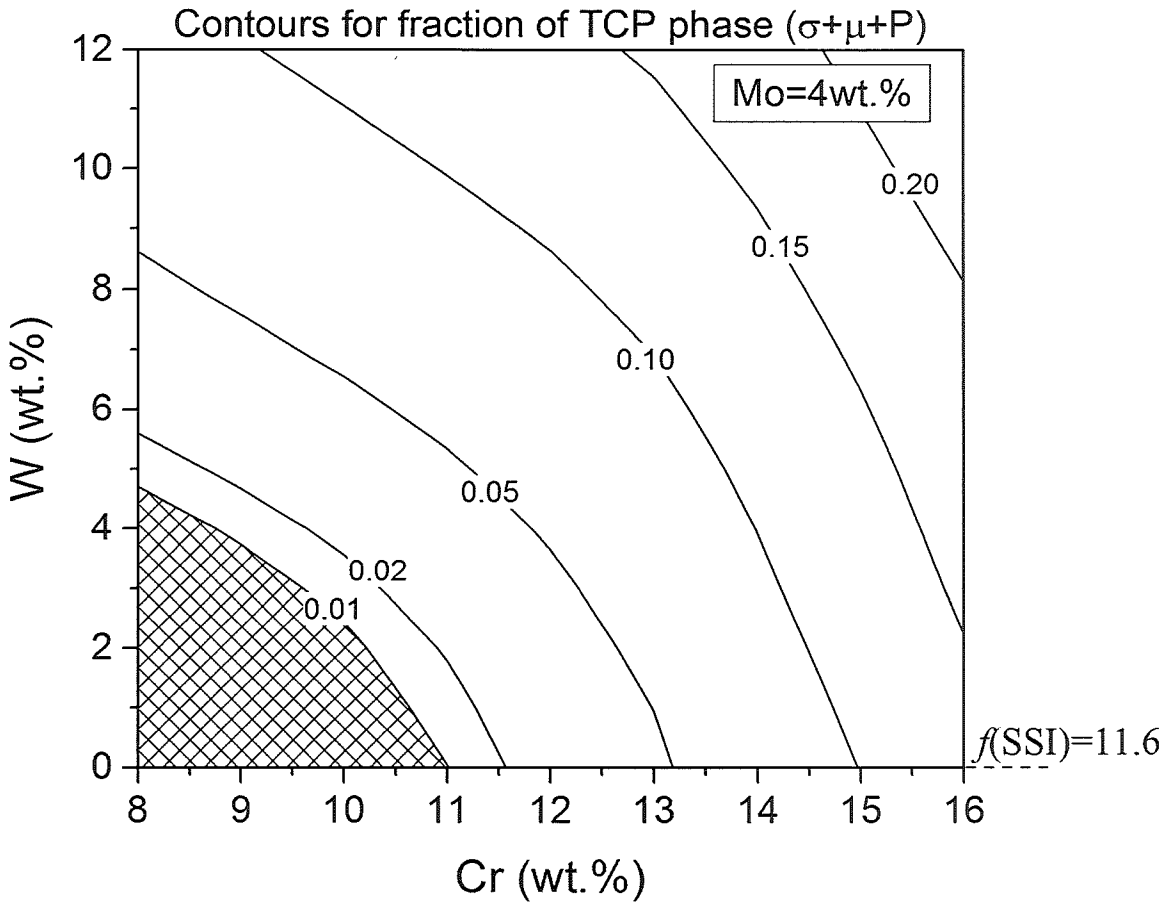
FIG. 12 is a contour plot showing the effect of tungsten and chromium on microstructural stability for alloys with a volume fraction of γ' between 55-70% when molybdenum content is fixed at 4 wt. %.
Figure 13:
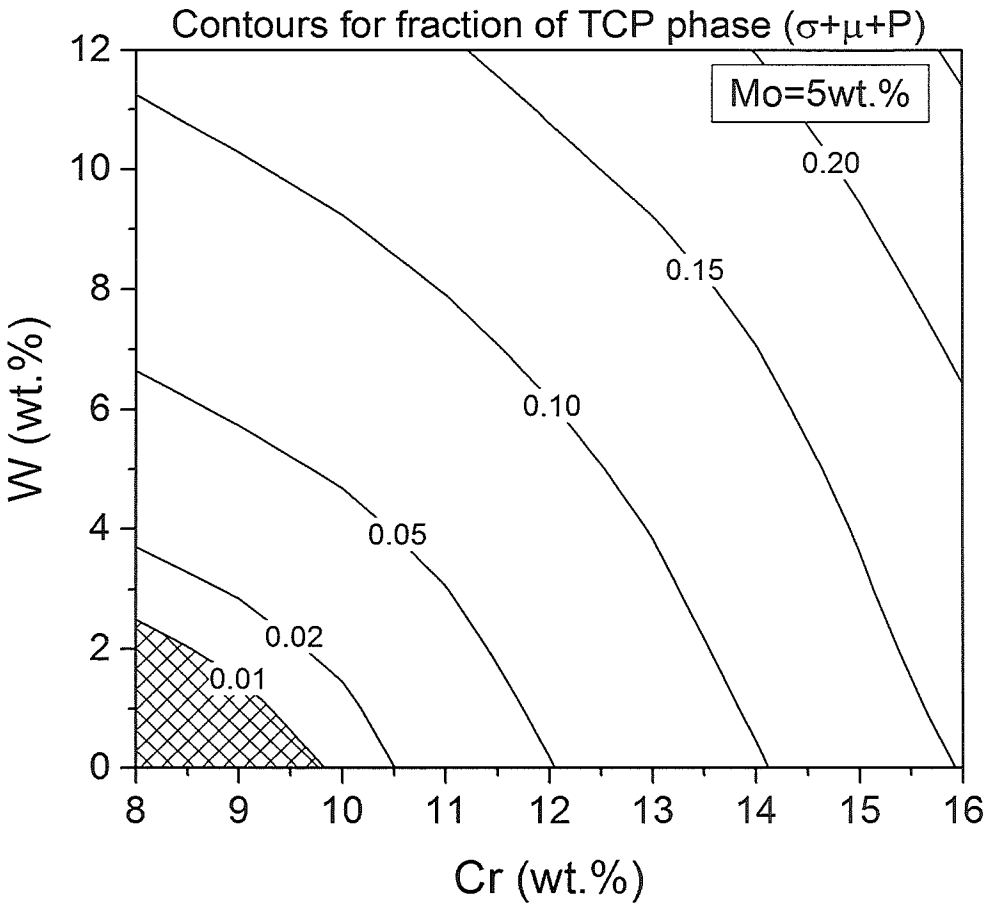
FIG. 13 is a contour plot showing the effect of tungsten and chromium on microstructural stability for alloys with a volume fraction of γ' between 55-70% when molybdenum content is fixed at 5 wt. %.
Figure 14:
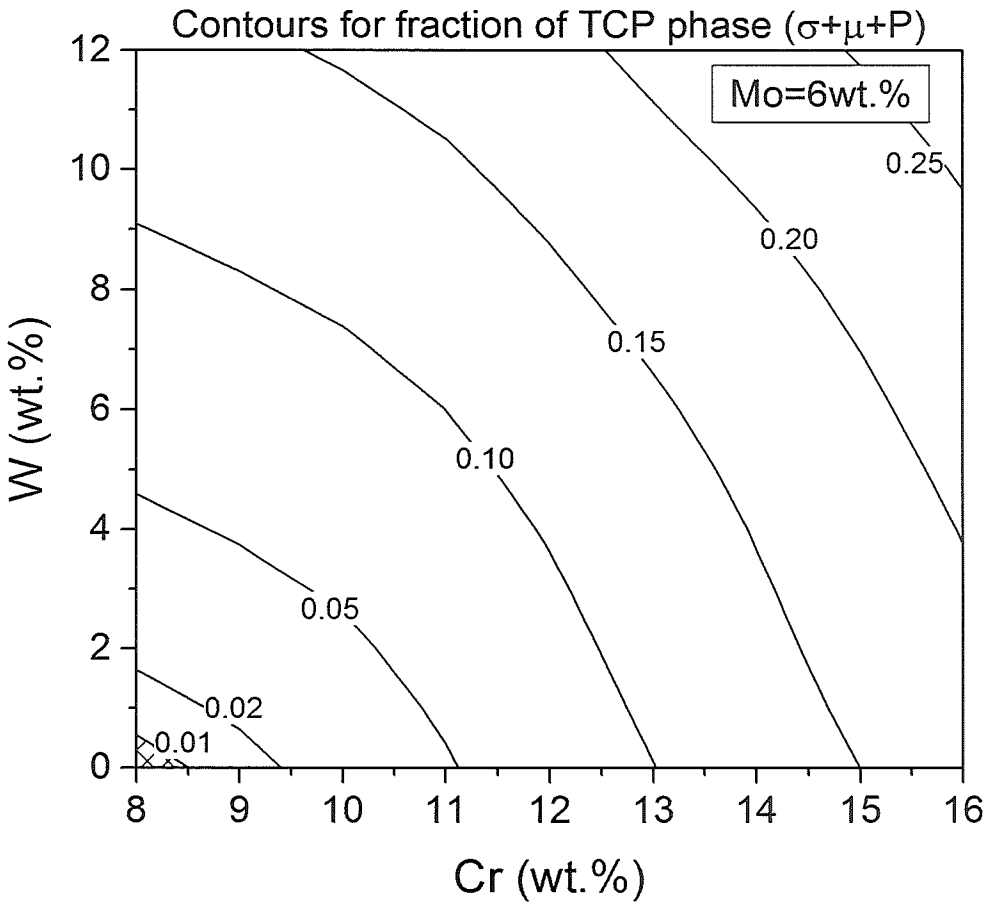
FIG. 14 is a contour plot showing the effect of tungsten and chromium on microstructural stability for alloys with a volume fraction of γ' between 55-70% when molybdenum content is fixed at 6 wt. %.

FIGS. 8-13 allow the following observations to be made, based on a maximum of 0.01 phase fraction of TCP phase. If the alloy does not contain molybdenum (FIG. 8) the chromium content is limited to 10.9 wt. %, it is also difficult to achieve the preferred value of f(SSI) at a chromium content of 9.1 wt. % or greater. When the alloy contains 1 wt. % of molybdenum (FIG. 9) the maximum chromium content is limited to 11.9 wt. % for a value of f(SSI)=9.4, similar maximal chromium content is achieved for molybdenum contents of 2 wt. % and 3 wt. % (FIG. 10-11), and the maximal chromium content reduces to 11.0 wt. % at 4 wt. % molybdenum (FIG. 12). For the best solid solution strengthening (i.e. f(SSI)≥11.6) the maximal chromium content increases with increasing molybdenum content up to 3 wt. % molybdenum (FIG. 9-12). Therefore a minimum molybdenum content is 0.1 wt. %, preferably 0.3 wt. % or 0.5 wt. %. At a molybdenum content of 1.0 wt. % the maximal chromium content when f(SSI)≥11.6 is 10.1 wt. % this is preferred minimum chromium content. Therefore it is preferred that the molybdenum content ranges between 1.0 wt. % and 3.0 wt. %, as the best balance of solid solution strengthening and oxidation/corrosion resistance is attained. Reducing the maximum amount of allowable molybdenum makes it easier to achieve the required f(SSI). Therefore preferably the amount of molybdenum is limited to 2.8 wt. % or less, more preferably to 2.5 wt. % or less.

Based upon the previous description it is found that the chromium content of the alloy is limited between 9.1 wt. % and 11.9 wt. %, more preferably between 10.1 wt. % and 11.9 wt. %. Most preferably it is limited between 10.1 wt. % and 11.0 wt. % as this produces the best balance of microstructural stability, solid solution strengthening and oxidation corrosion resistance. Higher levels of chromium desirably increase oxidation corrosion resistance so that chromium is preferably present in an amount of 10.3 wt. % or more, more preferably 10.5 wt. % or more.

Figure 8:
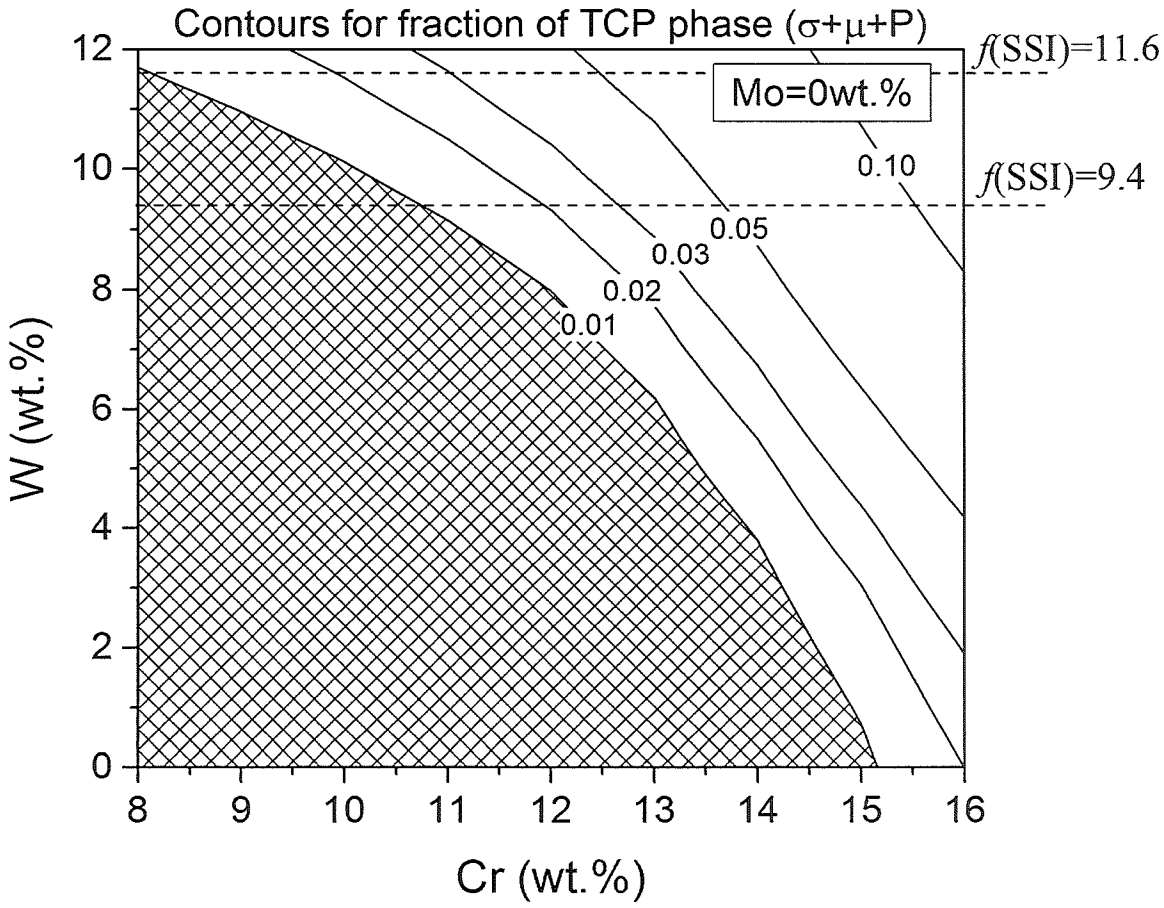
FIG. 8 is a contour plot showing the effect of tungsten and chromium on microstructural stability for alloys with a volume fraction of γ' between 55-70% when molybdenum content is fixed at 0 wt. %.
Figure 9:
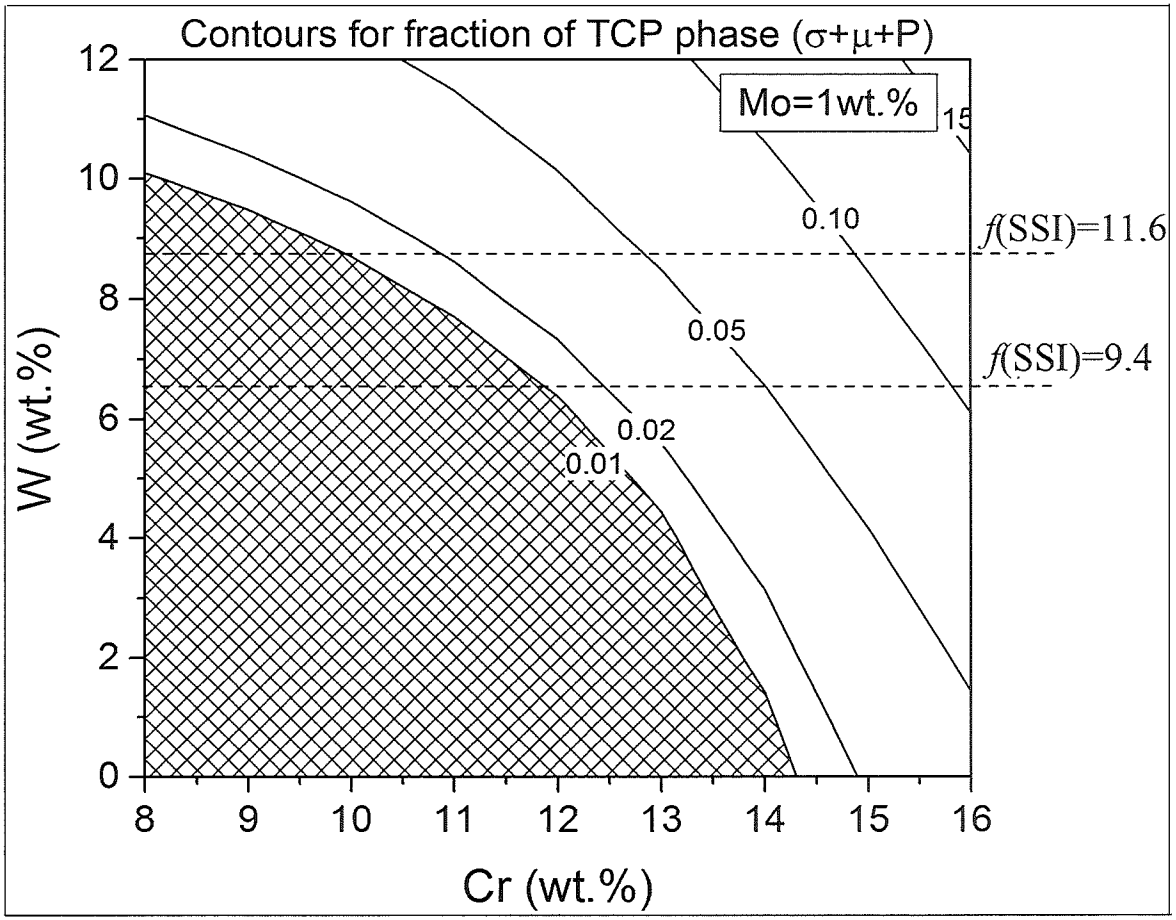
FIG. 9 is a contour plot showing the effect of tungsten and chromium on microstructural stability for alloys with a volume fraction of γ' between 55-70% when molybdenum content is fixed at 1 wt. %.
Figure 10:
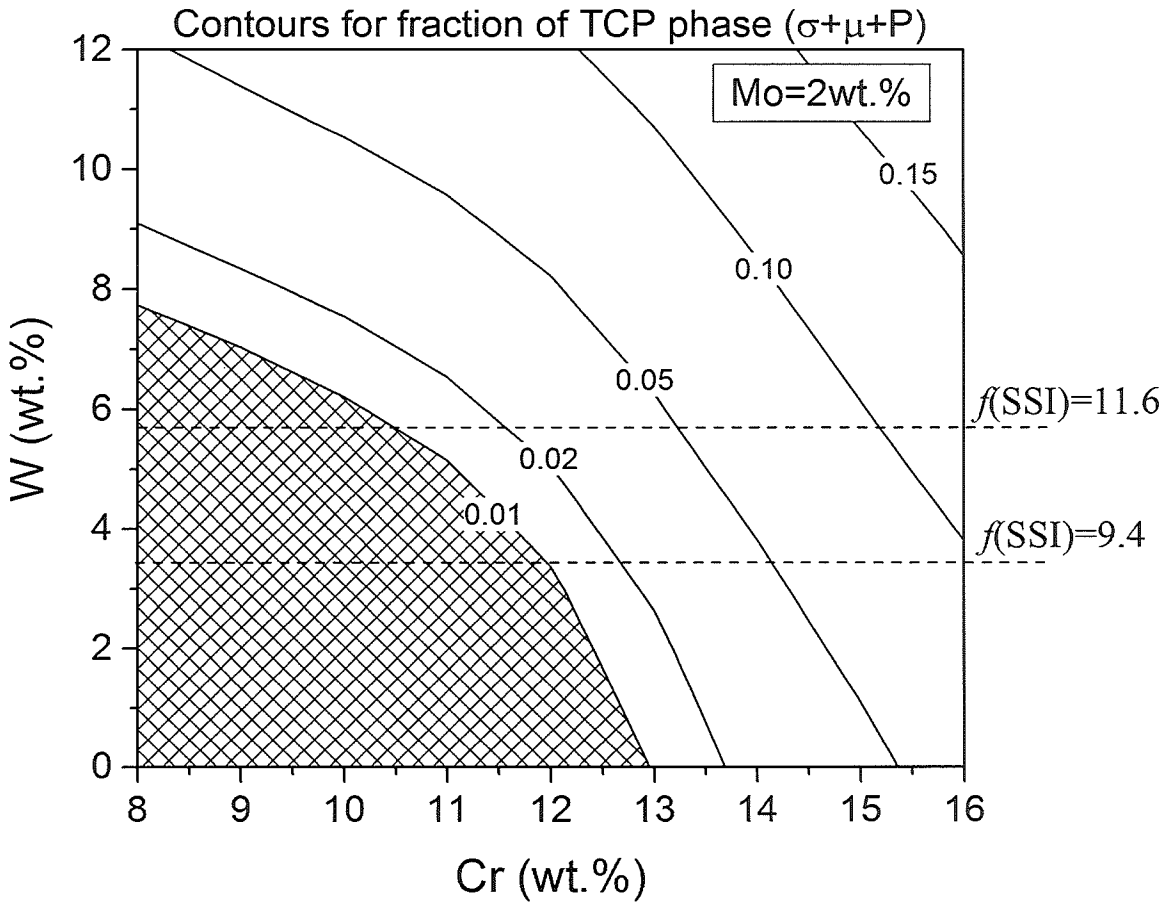
FIG. 10 is a contour plot showing the effect of tungsten and chromium on microstructural stability for alloys with a volume fraction of γ' between 55-70% when molybdenum content is fixed at 2 wt. %.
Figure 11:
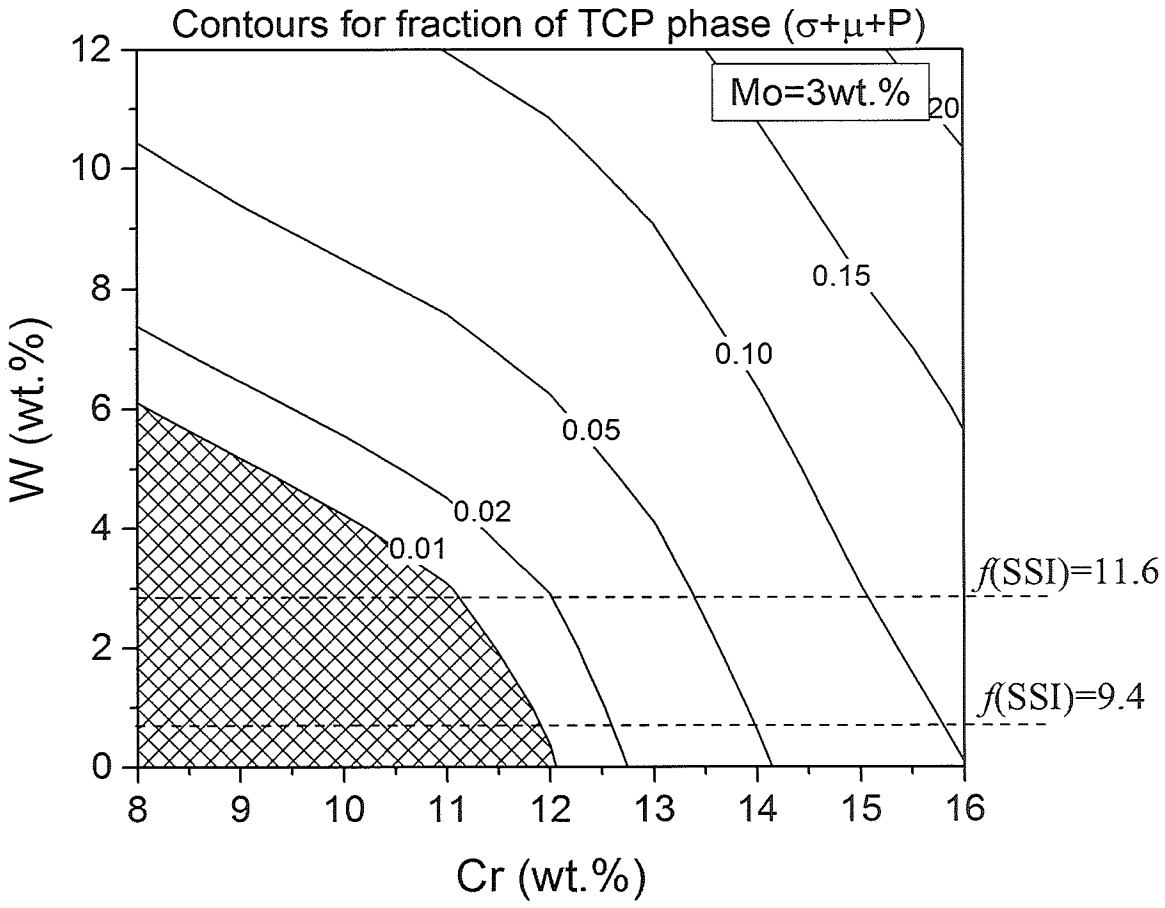
FIG. 11 is a contour plot showing the effect of tungsten and chromium on microstructural stability for alloys with a volume fraction of γ' between 55-70% when molybdenum content is fixed at 3 wt. %.

The maximum allowable tungsten content is 10.9 wt. %, based upon the minimum level of chromium (9.1 wt. %) required (FIG. 8). At the preferred upper limit of molybdenum of 3 wt. % it is desirable to include a minimum of 2.9 wt. % tungsten. This even allows for the preferred value for solid solution strengthening (f(SSI)≥11.6) to be achieved. In any case, an alloy with 2.9% or more tungsten will have improved solid solution strengthening and so this minimum level of tungsten is advantageous. Therefore a tungsten content between 2.9 wt. % and 10.6 wt. % is desired. Limiting tungsten to 8.0 wt % or less reduces density of the alloy and so is preferred. However, the alloy may contain no tungsten, particularly at high levels of molybdenum, where a f(SSI) of 11.6 can be achieved with molybdenum at 4.0% alone. It is desirable to maintain the sum of the elements molybdenum and tungsten below 10.6 wt. % to provide the required level of microstructural stability for the minimum chromium content of 9.1 wt. % (FIGS. 8-14). More preferably the sum of molybdenum and tungsten should remain below 9.9 wt. % such that the preferred chromium content of greater than 10.1 wt. % can be achieved (FIG. 8).

For the alloys which satisfied the previously described requirements it was necessary to optimise the levels of refractory elements for maximum creep resistance. The creep resistance was determined by using the creep merit index model. The influence which the sum of the elements molybdenum and tungsten and the additions of cobalt have on creep resistance is presented in FIG. 15. It is desirable to maximise the creep merit index as this is associated with an improved creep resistance. It is seen that increasing the levels of the sum of molybdenum and tungsten and the additions of cobalt will improve creep resistance.

A creep merit index of $5.0\times10^{-15}$ $m^{-2}s$ or greater was desired to produce an alloy with creep resistance substantially better than that of IN713C and IN713LC (see Table 3). More preferably a creep merit index of $7.0\times10^{-15}$ $m^{-2}s$ is desired to produce alloys with creep performance which is equivalent to Mar-M246 and Mar-M247. Even more preferably a creep merit index of $7.5\times10^{-15}$ $m^{-2}s$ is desired to produce alloys with a creep resistance better than Mar-M246 and Mar-M247

Figure 15:
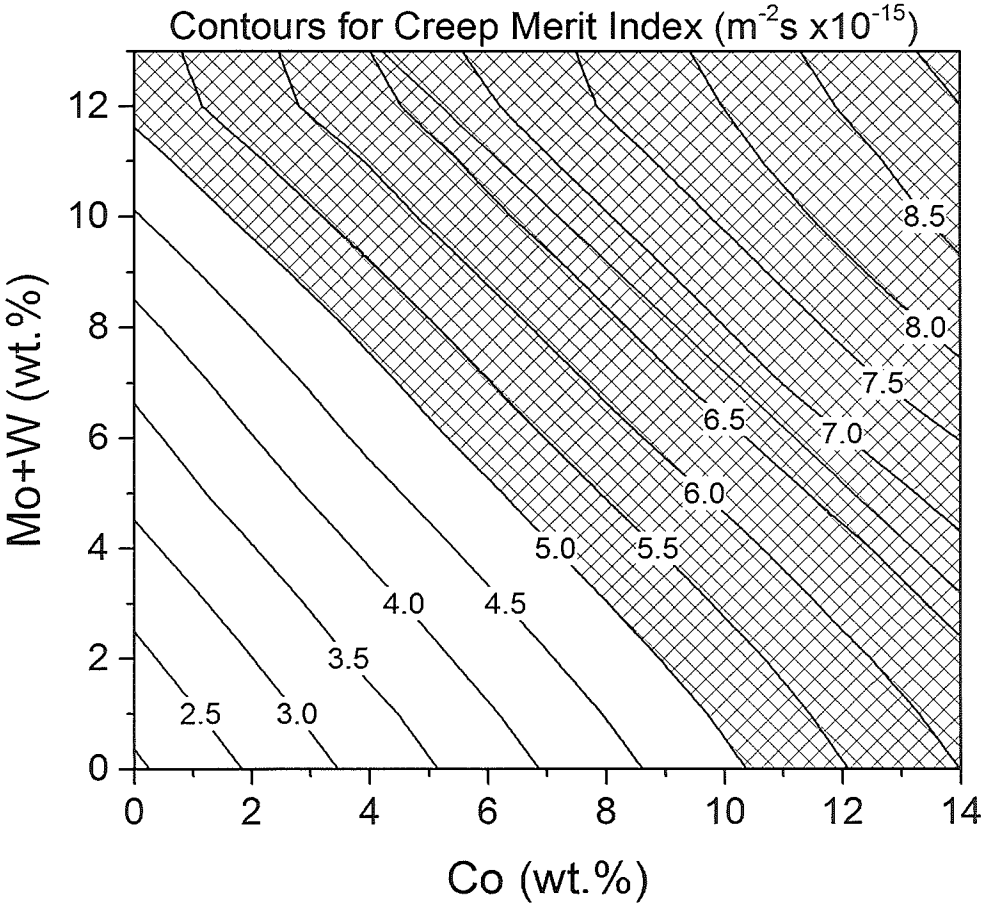
FIG. 15 is a contour plot showing the effect of cobalt and the sum of molybdenum and tungsten on creep resistance (in terms of creep merit index), for alloys with a volume fraction of γ' between 55-70%.

The minimum concentration of the sum of the elements cobalt, molybdenum and tungsten in order to produce an alloy with a creep merit index of $5.0\times10^{-15}$ $m^{-2}s$ or greater is greater than 11.2 wt. % (FIG. 15). The sum of the elements molybdenum and tungsten is desirably limited to 10.6 wt. %. Because of the rising cost of cobalt, preferably the alloy contains no cobalt or only a very small amount of cobalt such of at least 0.3 wt. % or at least 0.6 wt. % cobalt. In order to achieve the alloy cost target of less than 11 $/lb the sum of the elements cobalt, tungsten and molybdenum is desirably less than or equal to 26.6 wt. % (FIG. 5). The minimum sum of the elements molybdenum and tungsten is limited to 3.2 wt. %, more preferably 4.0 wt. %. Thus the maximum cobalt concentration is limited to 23.4 wt. %, more preferably 22.6 wt. % as this produces an alloy with a better balance of cost, solid solution strengthening and creep resistance. In order to reduce the cost of the alloy yet further, preferably the amount of cobalt is limited to 17.0 wt. % or less, more preferably to 15.0 wt. % or less cobalt.

For the best creep resistance the sum of cobalt, molybdenum and tungsten should be greater than 18.1 wt. % in order to produce an alloy with a creep merit index of $7.0\times10^{-15}$ $m^{-2}s$ equivalent to Mar-M246 and Mar-M247. Most preferably the sum of cobalt, molybdenum and tungsten must be greater than 19.8 wt. % to produce an alloy with a creep merit index of $7.5\times10^{-15}$ $m^{-2}s$, better than Mar-M246 and Mar-M247. Thus, where maximum achievable creep merit index is a driving factor it is preferred that cobalt is greater than 7.0 wt % or greater than 7.5 wt. % and even more preferably 9.2 wt. % in which case the maximum content of molybdenum and tungsten is limited to 10.6 wt. %.

Additions of carbon, boron and zirconium are required in order to provide strength to grain boundaries. This is particularly beneficial for the creep and fatigue properties of the alloy. The carbon concentrations should range between 0.02 wt. % and 0.35 wt. %. The boron concentration should range between 0.001 and 0.2 wt. %. The zirconium concentrations should range between 0.001 wt. % and 0.5 wt. %.

It is beneficial that when the alloy is produced, it is substantially free from incidental impurities. These impurities may include the elements sulphur (S), manganese (Mn) and copper (Cu). The element sulphur preferably remains below 0.003 wt. % (30 PPM in terms of mass). Manganese is an incidental impurity which is preferably limited to 0.25 wt. %. Copper (Cu) is an incidental impurity which is preferably limited to 0.5 wt. %. The presence of Sulphur above 0.003 wt. % can lead to embrittlement of the alloy and sulphur also segregates to alloy/oxide interfaces formed during oxidation. This segregation may lead to increased spallation of protective oxide scales. If the concentrations of these incidental impurities exceed the specified levels, issues surrounding product yield and deterioration of the material properties of the alloy is expected.

Additions of hafnium (Hf) of up to 0.5 wt. %, or more preferably up to 0.2 wt. % are beneficial for tying up incidental impurities in the alloy and also for providing strength. Hafnium is a strong carbide former it can provide additional grain boundary strengthening.

Additions of the so called 'reactive-elements', Yttrium (Y), Lanthanum (La) and Cerium (Ce) may be beneficial up to levels of 0.1 wt. % to improve the adhesion of protective oxide layers, such as $Al_2O_3$. These reactive elements can 'mop-up' tramp elements, for example sulphur, which segregates to the alloy oxide interface weakening the bond between oxide and substrate leading to oxide spallation. Additions of Silicon (Si) up to 0.5 wt. % may be beneficial, it has been shown that additions of silicon to nickel based superalloys at levels up to 0.5 wt. % are beneficial for oxidation properties. In particular silicon segregates to the alloy/oxide interface and improves cohesion of the oxide to the substrate. This reduces spallation of the oxide, hence, improving oxidation resistance.

Based upon the description of the invention presented in this section the broad range for the invention is listed in Table 4. A preferable range is also given in Table 4 as well as a most preferable range. Alloys 1-3 fall within the most preferable range and the experimental results presented below show advantages obtained in that compositional range. The preferable range has an increased minimum amount of aluminium and cobalt and a reduced maximum allowable level of titanium. This is thought to result in an improved balance of properties. However an alloy with the amounts of chromium, molybdenum, niobium, tantalum and tungsten of the broad range and a range of aluminium of 4.0 wt. % or more to less than 4.4 wt. %, of cobalt from 0.0 wt. % to less than 0.6 wt. % and amount of titanium of more than 2.0 wt. % to 3.0 wt. % or less might have certain advantages under specific conditions and so is included within the scope of the invention.

TABLE 4.

Compositional range in wt. % for the newly design alloy.

| Alloy (wt. %) | Al | Co | Cr | Mo | Nb | Ta | Ti | W |
|---|---|---|---|---|---|---|---|---|
| Min | 4.0 | 0.0 | 9.1 | 0.1 | 0.6 | 0.0 | 0.0 | 0.0 |
| Max | 6.9 | 23.4 | 11.9 | 4.0 | 3.7 | 1.0 | 3.0 | 10.9 |
| Preferable Min | 4.4 | 0.6 | 9.1 | 0.1 | 0.6 | 0.0 | 0.0 | 0.0 |
| Preferable Max | 6.9 | 23.4 | 11.9 | 4.0 | 3.7 | 1.0 | 2.0 | 10.9 |
| Most Preferable Min | 4.8 | 7.0 | 10.1 | 1.0 | 0.6 | 0.0 | 0.5 | 2.9 |
| Most Preferable Max | 6.7 | 15.0 | 11.9 | 2.5 | 3.0 | 0.5 | 2.5 | 8.0 |

Table 5 describes example compositions for from the present invention. The calculated properties for these new alloys are compared with the currently used alloys in Table 6. The rationale for the design of these alloys is now described.

The alloys of Examples 1-5 are designed to provide the lowest overall cost, with each alloy having a cost Equivalent to that of IN713C and IN713LC. The alloys have much higher value for strength merit index than Mar-M246 and Mar-M247, as well as a higher volume fraction of γ', this provides good high temperature mechanical behaviour. The alloys have been designed for low cost at the expense of creep resistance. The chromium levels are much higher than Mar-M246 and Mar-M247 providing much better oxidation/corrosion resistance.

The alloys of Examples 6-10 are designed to provide a balance of cost and creep resistance. The creep resistance is substantially improved in comparison to alloy Examples 1-5 at the expense of increased cost and a lowering in maximum chromium levels which decreased oxidation/corrosion behaviour. However, the alloys are still substantially lower cost than Mar-M246 and Mar-M247. Moreover the chromium levels are higher than Mar-M246 and Mar-M247. As with Examples 1-5 the alloys have much higher value for strength merit index than Mar-M246 and Mar-M247, as well as a higher volume fraction of γ', this provides good high temperature mechanical behaviour.

TABLE 5

Nominal compositions in wt. % of the newly designed conventionally cast nickel-based superalloys compared with the alloys listed in Table 1.

| Alloy (wt. %) | Al | Co | Cr | Mo | Nb | Ta | Ti | W | C | B | Zr | Hf |
|---|---|---|---|---|---|---|---|---|---|---|---|---|
| IN713C | 6.0 | 0.0 | 13.5 | 4.5 | 2.0 | 0.0 | 0.8 | 0.0 | 0.10 | 0.010 | 0.06 | 0.00 |
| IN713LC | 5.8 | 0.0 | 12.0 | 4.3 | 2.0 | 0.0 | 0.7 | 0.0 | 0.06 | 0.010 | 0.06 | 0.00 |
| Mar-M246 | 5.5 | 10.0 | 9.0 | 2.5 | 0.0 | 1.5 | 1.5 | 10.0 | 0.15 | 0.010 | 0.05 | 0.00 |
| Mar-M247 | 5.5 | 10.0 | 8.2 | 0.6 | 0.0 | 3.0 | 1.0 | 10.0 | 0.16 | 0.015 | 0.05 | 1.50 |
| Example 1 | 6.2 | 7.0 | 10.0 | 2.0 | 1.0 | 0.0 | 2.0 | 4.0 | 0.10 | 0.015 | 0.06 | 0.00 |
| Example 2 | 6.2 | 6.0 | 10.5 | 2.0 | 1.0 | 0.0 | 2.0 | 4.5 | 0.10 | 0.015 | 0.06 | 0.00 |
| Example 3 | 6.0 | 5.5 | 11.5 | 1.5 | 1.0 | 0.0 | 2.0 | 5.5 | 0.10 | 0.015 | 0.06 | 0.00 |
| Example 4 | 6.2 | 6.0 | 11.0 | 2.0 | 1.0 | 0.0 | 2.0 | 4.5 | 0.10 | 0.015 | 0.06 | 0.00 |
| Example 5 | 6.0 | 6.0 | 11.9 | 2.0 | 1.3 | 0.0 | 2.0 | 4.0 | 0.10 | 0.015 | 0.06 | 0.00 |
| Example 6 | 6.2 | 12.0 | 11.1 | 2.5 | 2.2 | 0.0 | 1.2 | 4.5 | 0.10 | 0.015 | 0.06 | 0.00 |
| Example 7 | 6.0 | 11.0 | 10.1 | 2.0 | 1.0 | 0.0 | 2.0 | 6.0 | 0.10 | 0.015 | 0.06 | 0.00 |
| Example 8 | 6.0 | 11.0 | 10.1 | 2.0 | 1.3 | 0.0 | 1.8 | 6.0 | 0.10 | 0.015 | 0.06 | 0.00 |
| Example 9 | 6.0 | 12.0 | 10.5 | 3.0 | 1.8 | 0.0 | 1.6 | 4.0 | 0.10 | 0.015 | 0.06 | 0.00 |
| Example 10 | 5.8 | 12.0 | 11.5 | 2.5 | 1.3 | 0.0 | 2.0 | 4.5 | 0.10 | 0.015 | 0.06 | 0.00 |
| Example 11 | 5.4 | 13.0 | 10.1 | 2.0 | 2.5 | 0.0 | 1.5 | 6.5 | 0.10 | 0.015 | 0.06 | 0.00 |
| Example 12 | 5.6 | 13.0 | 10.1 | 2.5 | 3.0 | 0.0 | 1.2 | 5.5 | 0.10 | 0.015 | 0.06 | 0.00 |
| Example 13 | 5.8 | 14.0 | 10.1 | 2.5 | 1.5 | 0.0 | 1.8 | 5.0 | 0.10 | 0.015 | 0.06 | 0.00 |
| Example 14 | 5.8 | 13.0 | 10.1 | 2.0 | 2.0 | 0.0 | 1.5 | 6.0 | 0.10 | 0.015 | 0.06 | 0.00 |
| Example 15 | 5.6 | 13.0 | 10.1 | 2.5 | 1.5 | 0.0 | 1.8 | 6.0 | 0.10 | 0.015 | 0.06 | 0.00 |

The alloys of Examples 11-15 are designed to provide the highest levels creep resistance, substantially better than Mar-M246 and Mar-M247. The creep resistance is substantially improved in comparison to alloy Examples 1-10 at the expense of increased cost and a lowering in maximum chromium levels which decreases oxidation/corrosion behaviour. However, the alloys are still substantially lower cost than Mar-M246 and Mar-M247 and the chromium levels are higher than Mar-M246 and Mar-M247. As with Examples 1-10 the alloys have much higher value for strength merit index than Mar-M246 and Mar-M247, as well as a higher volume fraction of γ', this provides good high temperature mechanical behaviour.

TABLE 6

Calculated phase fractions and merit indices made with the "Alloys-by-Design" software. Results for nickel-based superalloys used for producing a turbine wheel within an exhaust gas turbocharger device Table 1 and the nominal composition of the new alloys listed in Table 5.

| | Phase Fractions | | Creep Merit Index | Density | Cost | γ/γ' Misfit | HTW | Strength Merit Index | Solid Soluiton Merit Index |
|---|---|---|---|---|---|---|---|---|---|
| Alloy | γ' | σ + μ + P | ($m^{-2}s \times 10^{-15}$) | ($g/cm^3$) | ($/lb) | (%) | (° C.) | (Mpa) | (Mpa) |
| IN713C | 0.54 | 0.00 | 2.89 | 7.97 | 9.9 | −0.40% | 133 | 1133 | 89 |
| IN713LC | 0.52 | 0.00 | 2.57 | 8.03 | 10.0 | −0.25% | 145 | 1110 | 84 |
| Mar-M246 | 0.59 | 0.03 | 7.34 | 8.51 | 11.9 | −0.35% | 150 | 1246 | 90 |
| Mar-M247 | 0.58 | 0.00 | 7.52 | 8.60 | 13.1 | −0.16% | 141 | 1279 | 85 |
| Example 1 | 0.65 | 0.00 | 5.01 | 8.04 | 10.1 | −0.24% | 103 | 1300 | 84 |
| Example 2 | 0.66 | 0.00 | 5.23 | 8.05 | 10.1 | −0.30% | 103 | 1304 | 85 |
| Example 3 | 0.63 | 0.00 | 5.43 | 8.10 | 10.1 | −0.29% | 114 | 1302 | 84 |
| Example 4 | 0.65 | 0.00 | 5.28 | 8.05 | 10.1 | −0.33% | 105 | 1301 | 85 |
| Example 5 | 0.62 | 0.00 | 5.18 | 8.04 | 10.1 | −0.30% | 110 | 1308 | 85 |
| Example 6 | 0.65 | 0.00 | 7.11 | 8.07 | 10.6 | −0.39% | 96 | 1331 | 89 |
| Example 7 | 0.64 | 0.00 | 7.06 | 8.15 | 10.5 | −0.35% | 110 | 1313 | 88 |
| Example 8 | 0.63 | 0.00 | 7.02 | 8.17 | 10.6 | −0.33% | 109 | 1300 | 87 |
| Example 9 | 0.62 | 0.00 | 7.02 | 8.07 | 10.6 | −0.41% | 106 | 1312 | 91 |
| Example 10 | 0.59 | 0.00 | 7.02 | 8.10 | 10.6 | −0.37% | 116 | 1305 | 89 |
| Example 11 | 0.58 | 0.00 | 7.76 | 8.28 | 11.0 | −0.25% | 112 | 1360 | 90 |
| Example 12 | 0.59 | 0.00 | 7.51 | 8.22 | 10.9 | −0.31% | 112 | 1329 | 90 |
| Example 13 | 0.59 | 0.00 | 7.57 | 8.17 | 10.9 | −0.32% | 113 | 1303 | 88 |
| Example 14 | 0.61 | 0.00 | 7.60 | 8.22 | 11.0 | −0.29% | 103 | 1334 | 88 |
| Example 15 | 0.58 | 0.00 | 7.62 | 8.24 | 10.9 | −0.34% | 119 | 1306 | 91 |

DESCRIPTION OF EXPERIMENTAL RESULTS

Example compositions (Alloys 1-3) herein referred to as "experimental alloys" were selected from the most preferable compositional range defined in Table 4. The composition of these alloys are defined in Table 7. The experimental alloys were found to be amenable to standard methods used for the production of conventionally cast turbine wheel components. This production method involves: preparation of an alloy with the target composition specified in Table 7, preparation of a mould for casting the alloy using investment casting methods, casting the alloy to produce a turbine wheel component.

TABLE 7

Nominal composition in wt. % of Alloys 1-3 which were manufactured and experimentally tested.

| Alloy (wt. %) | Al | Co | Cr | Mo | Nb | Ta | Ti | W | C | B | Zr | Hf |
|---|---|---|---|---|---|---|---|---|---|---|---|---|
| Alloy 1 | 5.8 | 7.4 | 11.6 | 2.0 | 1.0 | 0.0 | 2.0 | 3.9 | 0.10 | 0.02 | 0.06 | 0.00 |
| Alloy 2 | 5.6 | 10.4 | 11.0 | 2.0 | 1.8 | 0.0 | 1.5 | 5.2 | 0.10 | 0.02 | 0.06 | 0.00 |
| Alloy 3 | 5.4 | 13.3 | 10.4 | 2.0 | 2.6 | 0.0 | 1.0 | 6.4 | 0.10 | 0.02 | 0.06 | 0.00 |

TABLE 8

Calculated phase fractions and merit indices made with the "Alloys-by-Design" software for Alloys 1-3 listed in Table 7.

| Alloy | Phase Fractions γ' | Phase Fractions σ + μ + P | Creep Merit Index ($m^{-2}s \times 10^{-15}$) | Density ($g/cm^3$) | Cost ($/lb) | γ/γ' Misfit (%) | Strength Merit Index (Mpa) | Solid Solution Merit Index (Mpa) |
|---|---|---|---|---|---|---|---|---|
| Alloy 1 | 0.57 | 0.00 | 5.51 | 8.05 | 10.1 | −0.23% | 1206 | 85 |
| Alloy 2 | 0.55 | 0.00 | 6.34 | 8.17 | 10.7 | −0.23% | 1210 | 89 |
| Alloy 3 | 0.55 | 0.00 | 7.43 | 8.29 | 10.9 | −0.23% | 1214 | 92 |

Experimental testing of the experimental alloys was used to validate the key material property target aimed at with the alloy of the invention; mainly sufficient mechanical strength (tested using tensile and creep tests) combined with good oxidation behaviour (tested with isothermal and cyclic oxidation), high microstructural stability and reduced alloy cost when compared to that of alloy Mar-M246. The behaviour of the experimental alloys was compared with alloys IN713C and Mar-M246, which were manufactured and tested under the same experimental conditions.

Conventionally cast test bars of Alloys 1-3 as well as IN713C and Mar-M246 of nominal composition according to Table 7 and Table 1. The cylindrical bars had dimensions of 12 mm diameter and 120 mm in length. Testing was conducted on the material in the as-cast condition for all alloys (i.e. no further heat-treatment was applied after casting).

Figure 16:
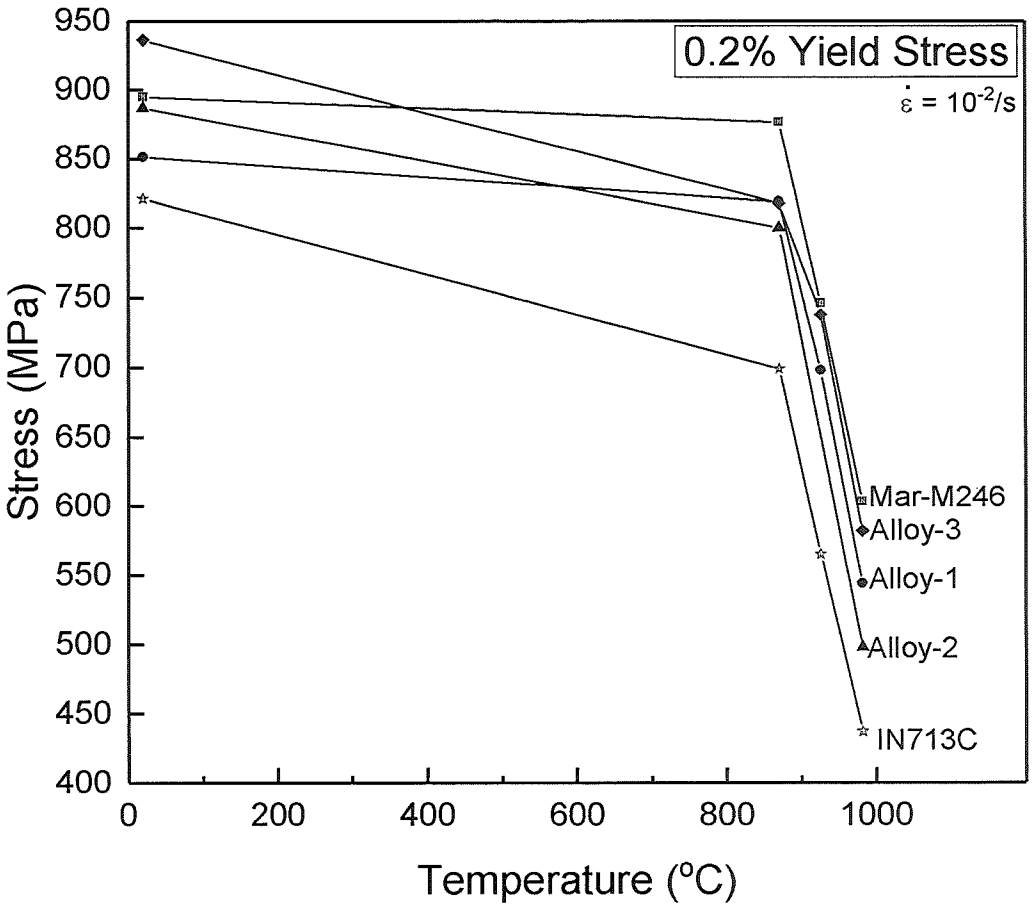
FIG. 16 shows yield stress for experimental alloys (Alloys 1-3) compared with alloys IN713C and Mar-M246.
Figure 17:
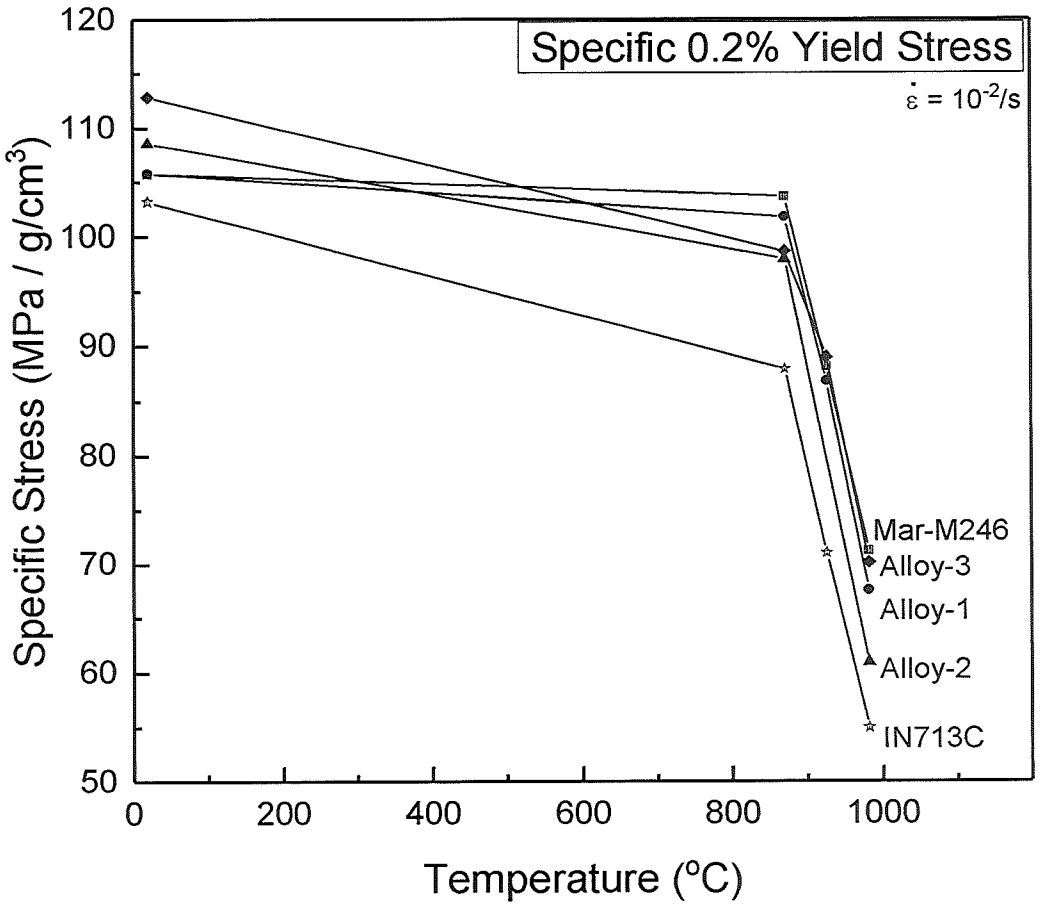
FIG. 17 shows specific yield stress for experimental alloys (Alloys 1-3) compared with alloys IN713C and Mar-M246.

Tensile testing was conducted according to ASTM E8M using 4 mm diameter specimens with a 20 mm gauge length. Tension tests were conducted at ambient temperature, 871° C. (1600 F), 926° C. (1700 F) and 982° C. (1800 F) using a strain rate of $10^{-2}$/s. The results show that the yield stress of the experimental alloys was substantially greater than IN713C, particularly in the high temperature range of 871–982° C. where an increase in strength of between 20-30% is observed (FIG. 16). The alloys achieved strength which were comparable to the target alloy Mar-M246 (FIG. 16). The experimental alloys in Table 7 have a lower density than Mar-M246. FIG. 17 compares the specific yield stress (yield stress÷density). This specific yield stress is the critical design criterion for rotating components where stresses reached are proportional to the density. It can be seen that on the basis of specific strength the experimental alloys have equivalent performance in terms of strength when compared to alloy Mar-M246.

Figure 18:
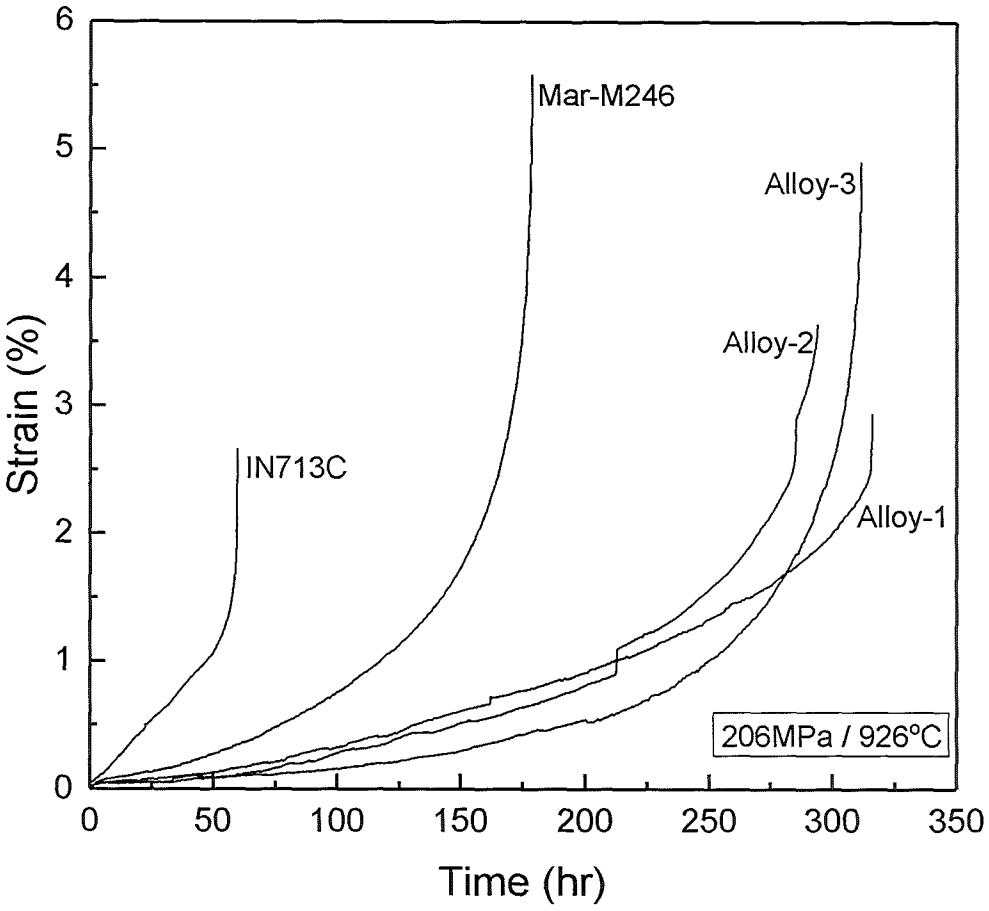
FIG. 18 shows creep strain versus time at a temperature of 926° C. and stress of 206 MPa for experimental alloys (Alloys 1-3) compared with alloys IN713C and Mar-M246.
Figure 19:
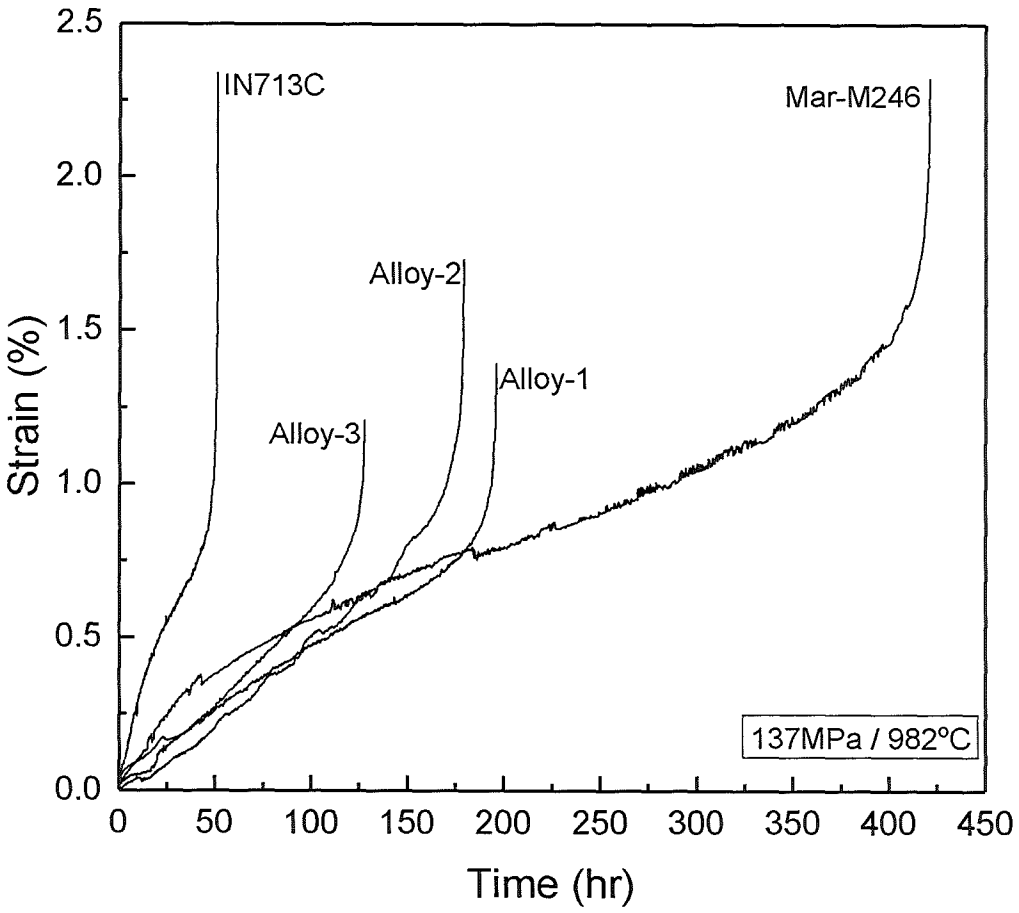
FIG. 19 shows creep strain versus time at a temperature of 982° C. and stress of 137 MPa for experimental alloys (Alloys 1-3) compared with alloys IN713C and Mar-M246.
Figure 20:
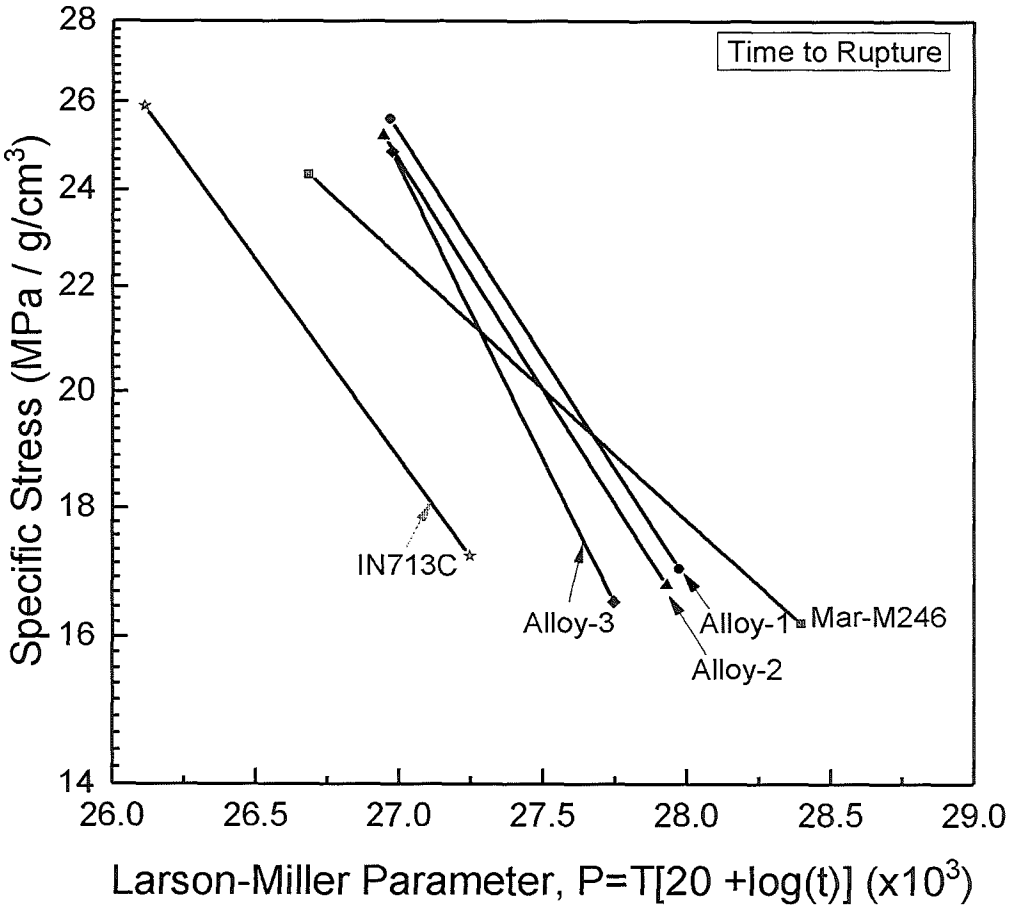
FIG. 20 shows the Larson-Miller Parameter calculated based upon rupture life versus specific stress for experimental alloys (Alloys 1-3) compared with alloys IN713C and Mar-M246.
Figure 21:
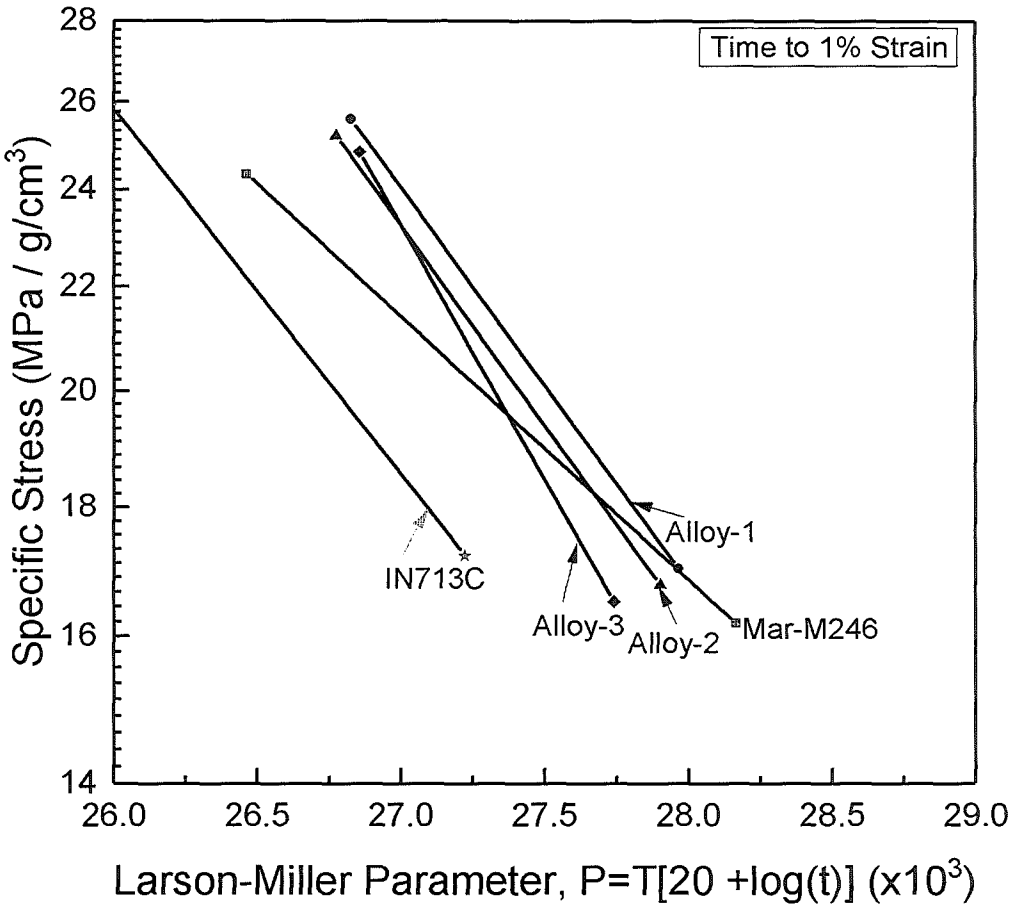
FIG. 21 shows the Larson-Miller Parameter calculated based upon time to 1% strain versus specific stress for experimental alloys (Alloys 1-3) compared with alloys IN713C and Mar-M246.
Figure 22:
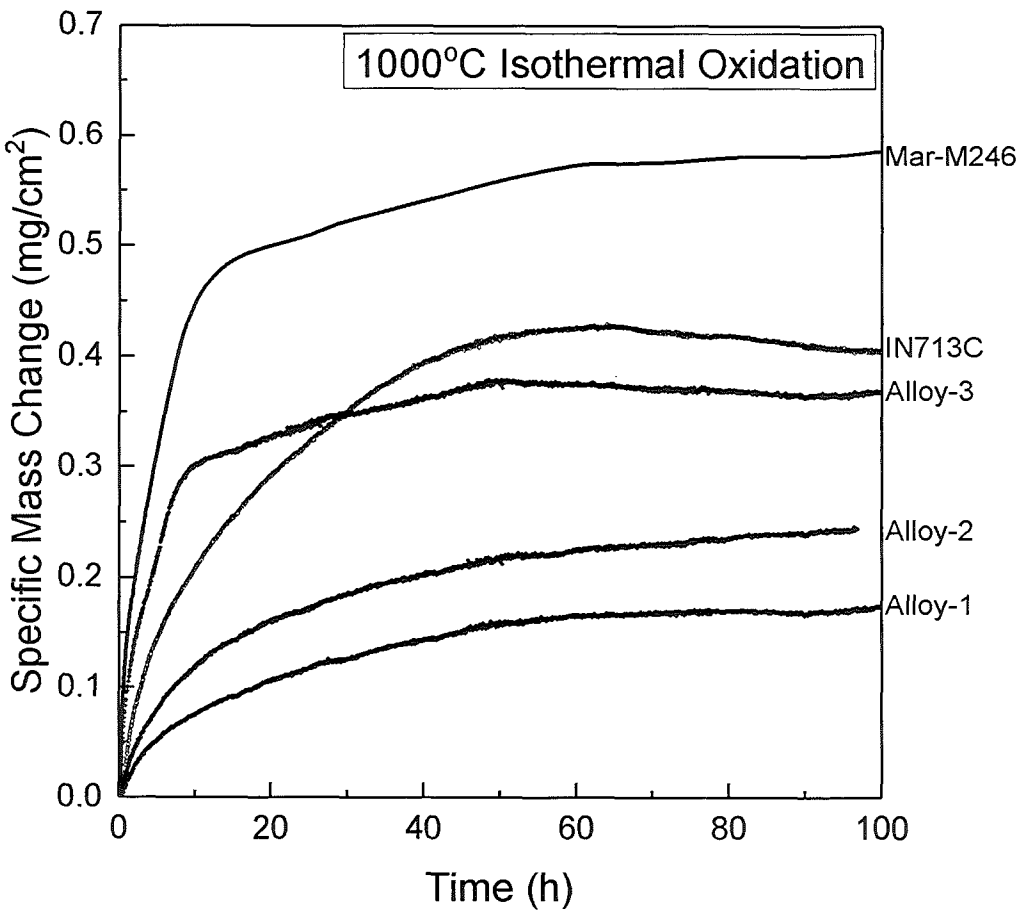
FIG. 22 shows the specific mass change for experimental alloys (Alloys 1-3) compared with alloys IN713C and Mar-M246 when held isothermally in laboratory air at 1000° C. for 100 hours.

Creep testing was conducted according to ASTM E139 using 4 mm diameter specimens with a 20 mm gauge length. Creep tests were performed at 926° C. using a stress level of 206 MPa and 982° C. using a stress level of 137 MPa. FIG. 18 shows the creep strain versus time for alloys in the 206 MPa/926° C. condition. It is seen that the experimental alloys outperform both IN713C and Mar-M246 in this condition. FIG. 19 shows the creep strain versus time for alloys in the 137 MPa/982° C. condition. The experimental alloys perform much better than IN713C. In terms of rupture life at 137 MPa/982° C. the alloy Mar-M246 performs better that the experimental alloys. However, typically in design of rotating components the time to a critical level of strain is the design target. Normally, the time to a strain of 1% or less is the design constraint. In terms of time to 1% strain the experimental alloys have equivalent performance to Mar-M246. Comparison of creep resistance measured from both creep tests is made using the Larson-Miller Parameter (LMP) in FIGS. 20-21. For the LMP comparison the specific stress is considered to account for differences in alloy density. In terms of LMP (based on rupture life) versus specific stress the experimental alloys show a substantial improvement in comparison to alloy IN713C, the performance is similar to Mar-M246 (FIG. 20). If LMP (based on time to 1% strain) is plotted against specific stress (FIG. 21) it is seen that the experimental alloys achieve performance which is equivalent to Mar-M246.

Figure 23:
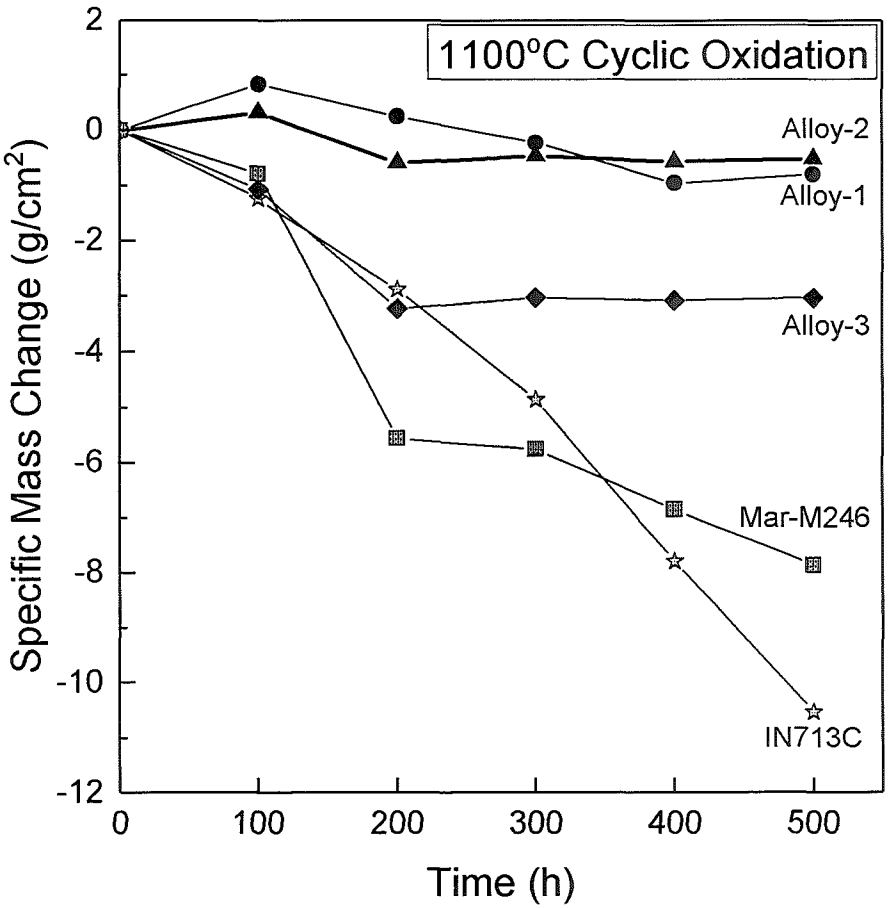
FIG. 23 shows the specific mass change for experimental alloys (Alloys 1-3) compared with alloys IN713C and Mar-M246 when exposed in laboratory air at 1100° C. for 100 hour cycles for a total time-period of 500 hours.

Isothermal oxidation kinetics at 1000° C. were measured using a thermogravimetric analysis (TGA) system. Samples of 10 mm diameter and 1 mm thick were prepared, all surfaces were ground to a 3 micron grit size for a consistent surface finish. Isothermal exposures were conducted for 100 hours with changes in the specific mass of the sample measured continually. A lower specific mass change over the 100 hour time-period is indicative of slower oxidation kinetics, with slower kinetics demonstrating better resistance to oxidation damage. Under these isothermal conditions the experimental alloys showed improved oxidation performance in comparison to alloy IN713C and Mar-M246 (FIG. 23).

The cyclic oxidation of the alloys also measured for the experimental alloys at 1100° C. Measurements were made over a time-period of 500 hours using 100 hour cycles. The cyclic nature of the thermal exposure at these high temperatures gives an indication of how resistant ant the alloy is to spallation (loss of protective oxides). A greater specific mass loss under these conditions is indicative of more oxide spallation which is undesirable. Under these conditions it is seen that there is substantially less specific mass loss for the experimental alloys in comparison to IN713C and Mar-M246. This demonstrated much better oxidation resistance in comparison to the IN713C and Mar-M246 alloys.

Figure 24:
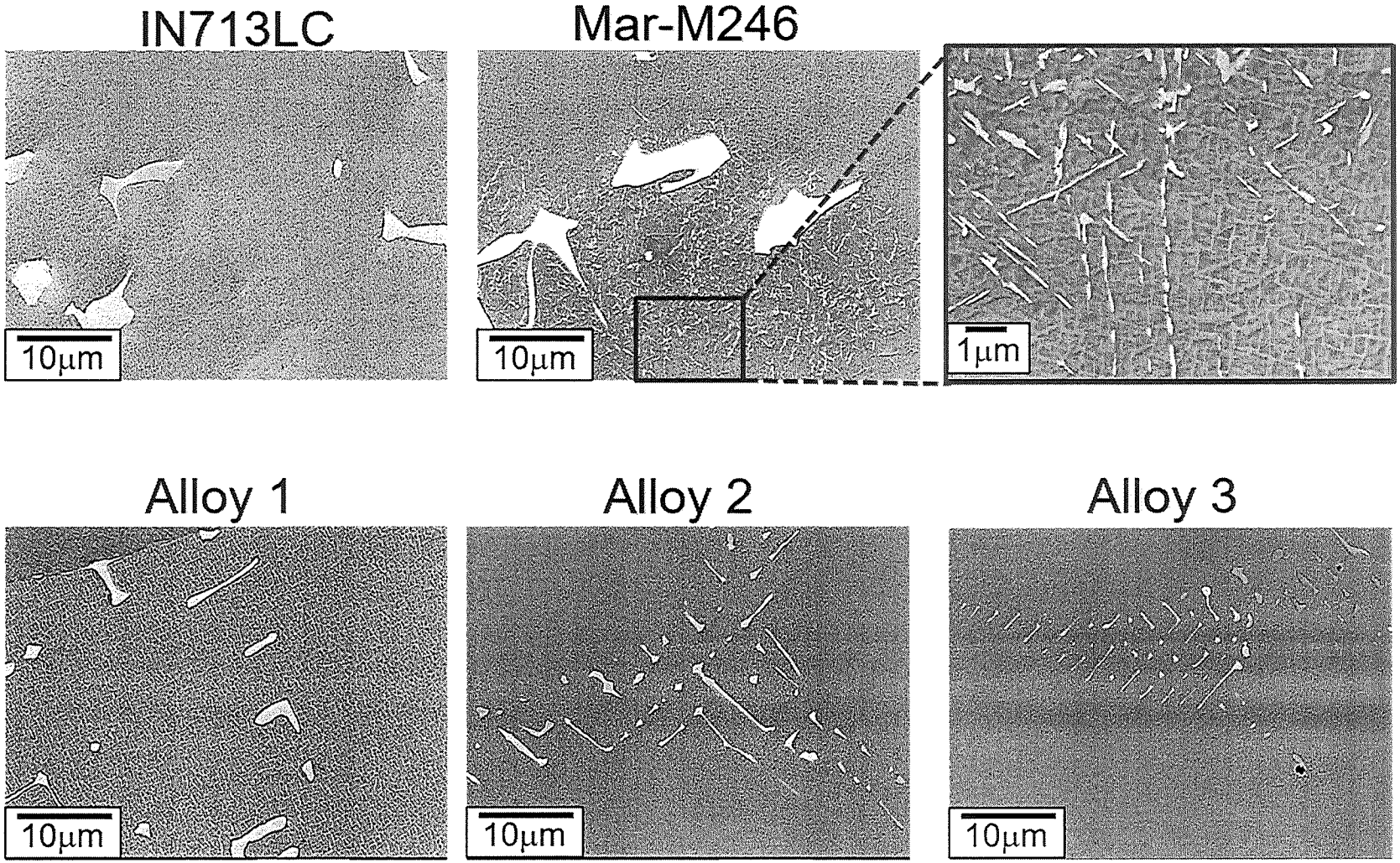
FIG. 24 shows microstructure of experimental alloys (Alloys 1-3) compared with alloys IN713C and Mar-M246 after thermal exposure for 1000 hours at 760° C.

The susceptibility of the alloys to form unwanted TCP phases was assessed through long term thermal exposure at 760° C. (1400 F). Specimens of each alloy were held isothermally at 760° C. for a time-period of 1000 hours. Following the thermal exposure samples were prepared for examination using scanning electron microscopy to observe any unwanted phase formation. FIG. 24 shows the microstructure for the alloys after this period of thermal exposure. The experimental alloys were found to be free from any unwanted phases, unwanted TCP phases were identified in Mar-M246. This demonstrates that the alloys have an improved microstructural stability in comparison to Mar-M246, the stability is equivalent to IN713C.

Overall the alloy the experimental alloys (Alloys 1-3) shows levels of yield strength—particularly on a density corrected basis—which are equivalent to Mar-M246 at temperature up to 982° C. The creep resistance—particularly when 1% strain conditions on a density corrected basis are considered—is equivalent to Mar-M246 and much better than IN713C. This has been achieved using an alloy with a significantly lower cost than Mar-M246, between 10-15% cost reduction in comparison to Mar-M246. Moreover the alloy benefits from substantial improvements in oxidation resistance and microstructural stability.

The invention claimed is:

1. A nickel-based alloy composition consisting, in weight percent, of: 4.8% to 6.9% aluminium, 0.0% to 17.0% cobalt, 10.1% to 11.9% chromium, 0.1% to 2.5% molybdenum, 1.5% to 3.7% niobium, 0.0% to 0.5% tantalum, 0.0% to 3.0% titanium, 2.9% to 10.9% tungsten, 0.02% to 0.35% carbon, 0.001% to 0.2% boron, 0.001% and 0.5% zirconium, 0.0% to 0.5% silicon, 0.0% to 0.1% yttrium, 0.0% to 0.1% lanthanum, 0.0% to 0.1% cerium, 0.0% to 0.003% sulphur, 0.0% to 0.25% manganese, 0.0% to 0.5% copper, 0.0% to 0.5% hafnium, 0.0% to 0.5% vanadium, 0.0% to 10.0% iron, the balance being nickel and incidental impurities;

wherein the following equation is satisfied in which $W_W$ and $W_{Mo}$ are the weight percent of tungsten and molybdenum in the alloy respectively $$11.6 \leq W_W + 2.9 W_{Mo}.$$

2. The nickel-based alloy composition according to claim 1, wherein the following equation is satisfied in which $W_{Nb}$, $W_{Ta}$, $W_{Ti}$ and $W_{Al}$ are the weight percent of niobium, tantalum, titanium and aluminium in the alloy respectively $$19 \leq (W_{Nb} + W_{Ta} + W_{Ti}) + 3.2 W_{Al} \leq 24.5.$$

3. The nickel-based alloy composition of claim 1 consisting, in weight percent, of 10.1% to 11.0% or less chromium.

4. The nickel-based alloy composition of claim 1 consisting, in weight percent, of 0.3% to 2.5% molybdenum.

5. The nickel-based alloy composition of claim 1 consisting, in weight percent, of 0.0% to 2.5% titanium.

6. The nickel-based alloy composition of claim 1 consisting, in weight percent, of 0.0% to 15.0% cobalt.

7. The nickel-based alloy composition of claim 1 consisting, in weight percent, of 0.2% or less hafnium.

8. The nickel-based alloy composition of claim 1 consisting, in weight percent, of 0.5% or less than 0.5% tantalum.

9. The nickel-based alloy composition of claim 1, wherein the sum of elements cobalt, tungsten and molybdenum, in weight, is 26.6% or less.

10. The nickel-based alloy composition of claim 1 consisting of, in weight percent, 0.0% to 8.0% iron.

11. The nickel-based alloy composition of claim 1, wherein the sum of elements molybdenum and tungsten, in weight percent, is 10.6% or less, and/or where the sum of elements molybdenum and tungsten, in weight percent, is 3.2% or more.

12. The nickel-based alloy composition of claim 1, consisting, in weight percent, of 4.8% to 6.8% aluminium.

13. The nickel-based alloy composition of claim 1, wherein the following equation is satisfied in which $W_{Nb}$, $W_{Ta}$ and $W_{Ti}$ are the weight percent of niobium, tantalum and titanium in the alloy respectively $$W_{Nb} + W_{Ta} + W_{Ti} \geq 2.6.$$

14. The nickel-based alloy composition of claim 1, wherein the ratio of the sum of the elements niobium, tantalum and titanium to aluminium by weight percent is greater than 0.45.

15. The nickel based alloy composition of claim 1, having 1.5 wt. % to 3.0 wt. % niobium.

16. The nickel-based alloy composition of claim 15 consisting, in weight percent, of less than 0.5% tantalum.

17. The nickel based alloy composition of claim 1, having 10.6 wt. % or less tungsten.

18. The nickel-based alloy composition of claim 1 consisting, in weight percent, of less than 0.5% hafnium.

* * * * *